US010966589B2

(12) United States Patent
Gregory et al.

(10) Patent No.: US 10,966,589 B2
(45) Date of Patent: Apr. 6, 2021

(54) DEBRIS PAN AND ASSOCIATED ASSEMBLIES

(71) Applicant: Rubbermaid Commercial Products LLC, Atlanta, GA (US)

(72) Inventors: Mike Gregory, Huntersville, NC (US); Marcel Arantes Souza, Kalamazoo, MI (US); Josh Hansen, Mattawan, MI (US); Allen Wong, Portage, MI (US); Hillary Pullen, Charlotte, NC (US)

(73) Assignee: Rubbermaid Commercial Products LLC, Atlanta, GA (US)

( * ) Notice: Subject to any disclaimer, the term of this patent is extended or adjusted under 35 U.S.C. 154(b) by 192 days.

(21) Appl. No.: 16/198,073

(22) Filed: Nov. 21, 2018

(65) Prior Publication Data

US 2019/0150698 A1 May 23, 2019

Related U.S. Application Data

(60) Provisional application No. 62/589,580, filed on Nov. 22, 2017.

(51) Int. Cl.
*A47L 13/52* (2006.01)

(52) U.S. Cl.
CPC ..... *A47L 13/52* (2013.01)

(58) Field of Classification Search
CPC ..... A47L 13/52
USPC ..... 15/257.1–257.9; D32/74
See application file for complete search history.

(56) References Cited

U.S. PATENT DOCUMENTS

| | | | | | |
|---|---|---|---|---|---|
| 41,771 | A | * | 3/1864 | Harold | 15/257.1 |
| 390,781 | A | * | 10/1888 | Hebden et al. | 15/257.7 |
| 718,783 | A | * | 1/1903 | McIntire | 15/257.8 |
| 916,767 | A | * | 3/1909 | Ogden | 15/257.7 |

(Continued)

FOREIGN PATENT DOCUMENTS

| | | | |
|---|---|---|---|
| DE | 29706895 | * | 8/1997 |
| EP | 865757 | * | 9/1998 |

(Continued)

OTHER PUBLICATIONS

Continental 915RD Jumbo Lobby Dustpan, red, admitted prior art (1 pg.).

(Continued)

*Primary Examiner* — Mark Spisich
(74) *Attorney, Agent, or Firm* — Eversheds Sutherland (US) LLP

(57) ABSTRACT

Debris pans and debris pan assemblies are provided. A debris pan includes a bin with an open end for receiving debris and a closed interior for containing debris. A plurality of baffles protrude from a floor of the closed interior, and the plurality of baffles may be configured to slow debris flow inside the closed interior. A debris pan assembly includes a bin, a yoke attached to the bin, and an elongated shaft attached to the yoke. The debris pan assembly also includes a latch on the bin that is selectively pivotable between a first position and a second position. The first position of the latch is configured to engage the yoke such that the bin and the yoke are rigidly positioned relative to one another. The second position of the latch is configured to disengage the yoke from the bin.

20 Claims, 20 Drawing Sheets

(56) References Cited

U.S. PATENT DOCUMENTS

| | | | | | |
|---|---|---|---|---|---|
| 1,355,577 | A | * | 10/1920 | Sperling | A47L 13/52 15/257.7 |
| 1,748,336 | A | * | 2/1930 | Finnell | A47L 13/52 15/257.3 |
| 2,699,050 | A | * | 1/1955 | MacKay | A47L 13/52 15/257.7 |
| 4,986,587 | A | * | 1/1991 | Lozano | E01H 1/1206 15/257.1 |
| 5,012,542 | A | | 5/1991 | Lynn | |
| 5,412,835 | A | * | 5/1995 | Vosbikian | A47L 13/52 15/144.1 |
| 5,457,844 | A | * | 10/1995 | Hanna | A47L 13/52 141/391 |
| 5,548,864 | A | * | 8/1996 | Vosbikian | A47L 13/52 15/144.1 |
| 5,839,145 | A | | 11/1998 | Petner | |
| 6,023,812 | A | | 2/2000 | Morad | |
| 6,230,361 | B1 | | 5/2001 | Griffin | |
| 6,233,780 | B1 | | 5/2001 | Mead | |
| 6,233,781 | B1 | | 5/2001 | Savage | |
| 6,282,745 | B1 | * | 9/2001 | Alt | A47L 13/52 15/257.4 |
| D470,289 | S | | 2/2003 | Petner | |
| D473,030 | S | | 4/2003 | Sons | |
| D475,828 | S | | 6/2003 | Libman | |
| D481,504 | S | | 10/2003 | Libman | |
| D484,659 | S | | 12/2003 | Perelli | |
| 6,679,948 | B2 | | 1/2004 | Mead | |
| D493,265 | S | | 7/2004 | Libman | |
| D508,760 | S | | 8/2005 | Berti | |
| D509,035 | S | | 8/2005 | Libman | |
| 6,935,678 | B1 | | 8/2005 | Libman | |
| D510,165 | S | | 9/2005 | Berti | |
| D537,597 | S | | 2/2007 | Bolden | |
| D545,022 | S | | 6/2007 | Morad | |
| 7,404,229 | B2 | | 7/2008 | Monahan | |
| D586,519 | S | | 2/2009 | Casteel | |
| 7,509,705 | B1 | | 3/2009 | Morad | |
| D594,618 | S | | 6/2009 | Sekercioglu | |
| D595,509 | S | | 7/2009 | Sekercioglu | |
| D596,408 | S | | 7/2009 | Cohen | |
| D601,769 | S | | 10/2009 | Cox | |
| 7,677,508 | B1 | | 3/2010 | Owens | |
| D615,267 | S | | 5/2010 | McNeil | |
| 7,735,008 | B2 | | 6/2010 | Altman | |
| 7,736,009 | B2 | | 6/2010 | Quattrini | |
| D630,401 | S | | 1/2011 | Libman | |
| D630,402 | S | | 1/2011 | Wang | |
| D630,403 | S | | 1/2011 | Raven | |
| D636,139 | S | | 4/2011 | Jones | |
| 7,921,505 | B1 | | 4/2011 | Moore | |
| 8,003,725 | B2 | | 8/2011 | Chapman | |
| 8,152,019 | B1 | | 4/2012 | Miller | |
| 8,523,007 | B2 | | 9/2013 | Miller | |
| 8,555,459 | B2 | | 10/2013 | Ward | |
| 8,701,243 | B2 | | 4/2014 | Ward | |
| 8,840,122 | B1 | | 9/2014 | Cummins | |
| 9,181,666 | B2 | | 11/2015 | Shnol | |
| 9,192,146 | B2 | | 11/2015 | Trogdon | |
| D747,585 | S | | 1/2016 | Schantz | |
| 9,282,861 | B2 | | 3/2016 | Schultz | |
| 9,315,306 | B2 | | 4/2016 | Taber | |
| 9,386,901 | B1 | | 7/2016 | Baker | |
| D774,267 | S | | 12/2016 | Dobson | |
| D826,503 | S | | 8/2018 | Dobson, III | |
| 2003/0167588 | A1 | * | 9/2003 | Perelli | A47L 13/52 15/257.7 |
| 2006/0288617 | A1 | | 12/2006 | Colclough | |
| 2007/0163069 | A1 | * | 7/2007 | Sampaio | A47L 13/52 15/257.7 |

FOREIGN PATENT DOCUMENTS

| | | | |
|---|---|---|---|
| GB | 977795 | * | 12/1964 |
| GB | 2367483 | * | 2/2002 |
| JP | 2005-21432 | * | 1/2005 |

OTHER PUBLICATIONS

Harper Jumbo Debris Pan, 497-04, admitted prior art (1 pg.).
#RCP9M00BLA Lobby Pro Wet/Dry Spill Pan, Rubbermaid Commercial Products, admitted prior art (2 pgs.).
Quickie Jumbo Debris Dust Pan with Handle, admitted prior art (1 pg.).

* cited by examiner

DEBRIS PAN AND ASSOCIATED ASSEMBLIES

CROSS-REFERENCE TO RELATED APPLICATIONS

This application claims the benefit of priority to U.S. Provisional Application No. 62/589,580, filed on Nov. 22, 2017, which is incorporated by reference herein in its entirety.

FIELD OF DISCLOSURE

The present disclosure relates generally to debris pans, and more specifically to debris pans having internal baffles and/or a latch mechanism.

BACKGROUND

Debris pans (or dustpans) are commonly used to pick up dry particles such as trash and other objects lying on the ground. Traditionally, these debris pans may allow dust particles and liquid substances to spill back onto the floor. Furthermore, traditional debris pans may swing erratically once the bin is lifted from the ground. Because the receptacle is capable of free movement without restriction, whenever a user moves the bin or decides to empty the bin, the receptacle may rotate without any control by the user. These two aspects may cause inefficiency for a user because the material, both liquid and solid, may fall out of the pan.

Accordingly, there is a need for a debris pan configured to reduce the amount of liquid and other debris that will escape from the bin during use and/or to prevent the free movement of the bin when a user lifts the pan.

SUMMARY

In one aspect, a debris pan assembly is provided. The debris pan assembly includes a bin with a closed interior for containing debris. The closed interior is defined by at least one sidewall. The bin also has an open end for receiving debris therethrough. The debris pan assembly includes a yoke attached to the bin. The debris pan assembly also includes an elongated shaft. The elongated shaft may include a first end and an opposed second end. The opposed second end of the elongated shaft attaches to the yoke. The debris pan assembly includes a latch attached to the bin, and the latch is selectively pivotable between a first position and a second position. In the first position, the latch engages the yoke such that the pin and the yoke are rigidly positioned relative to one another. In the second position, the bin and the yoke are not rigidly positioned relative to one another.

In another aspect, a debris pan is provided. The debris pan includes a bin with a closed interior. The closed interior includes a floor, a front ledge, and at least one sidewall. The bin includes an open end for receiving debris. The debris pan also includes a plurality of baffles protruding from the floor of the closed interior. Each of the plurality of baffles includes a first surface facing an open end and a second opposed surface. The plurality of baffles are configured to slow debris flow within the closed interior, and at least two baffles separately extend from the at least one sidewall of the bin.

In yet another aspect, a debris pan assembly is provided. The debris pan assembly includes a bin with a closed interior for containing debris. The closed interior is defined by at least one sidewall. The bin has an open end for receiving debris therethrough. The debris pan assembly includes a yoke attached to the bin. Further, a latch is attached to the bin, and the latch is selectively pivotable between a first position where the latch engages the yoke such that the bin and the yoke are rigidly positioned relative to one another and a second position. In the second position, the bin and the yoke are not rigidly positioned relative to one another.

BRIEF DESCRIPTION OF THE DRAWINGS

Referring now to the drawings, which are meant to be exemplary and not limiting, and wherein like elements are numbered alike. The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

The present disclosure provides for a debris pan. For example, the debris pan may include a bin with a closed interior and an open end for receiving debris. In some instances, the bin includes a plurality of baffles disposed on a floor of the closed interior, and the plurality of baffles may be configured to slow debris within the bin. For example, the baffles may be in a staggered formation to slow the escape of liquid from within the closed interior as the bin sways and rotates. That is, the baffles may act as obstacles for wet and dry debris swept into the bin from escaping through the open end.

The present disclosure provides for a debris pan assembly. For example, the debris pan assembly may include a bin configured to selectively move and/or rotate to capture debris. In some instances, the debris pan assembly may include a bin, a yoke rotatably attached to the bin, an elongated shaft extending from the yoke, and a latch on the bin configured to engage the yoke. In this manner, when the latch is in a first position, the latch may prevent rotational movement of the bin and the yoke. In a second position, the latch may disengage the yoke and allow rotational movement. In other instances, the bin may be attached to a ball joint, swivel, or some other type of rotatable mechanism configured to position the bin in a particular direction.

In one aspect, the present disclosure provides a latch mechanism for simple control of a debris pan. For example, a latch mechanism attached to the bin of the debris pan may be capable of locking the bin into place (relative to the elongated shaft or handle of the debris pan assembly) by rotating the latch. Locking the bin into place may be useful for improved control of the debris pan assembly when filling or emptying the bin. Accordingly, unlocking the bin may allow for rotation of the bin to a position to carry or dispose of debris.

In one embodiment, a debris pan assembly includes a bin having a closed interior, a yoke coupled to the bin, an elongated shaft having a first end and an opposed second end, and a latch coupled to the bin. The latch may be provided on an upper surface of the bin, such that a user can manually (e.g., with the hand or foot) pivot the latch between its positions. For example, pivoting the latch by a user's foot may be ergonomic and efficient for a user.

Various debris pans designs are known in the art and may be used in combination with the features described herein. That is, the present disclosure is not intended to be limited to a particular design or style of debris pan assembly, and the illustrated and described embodiments should be considered exemplary.

Debris Pans

Figure 1:
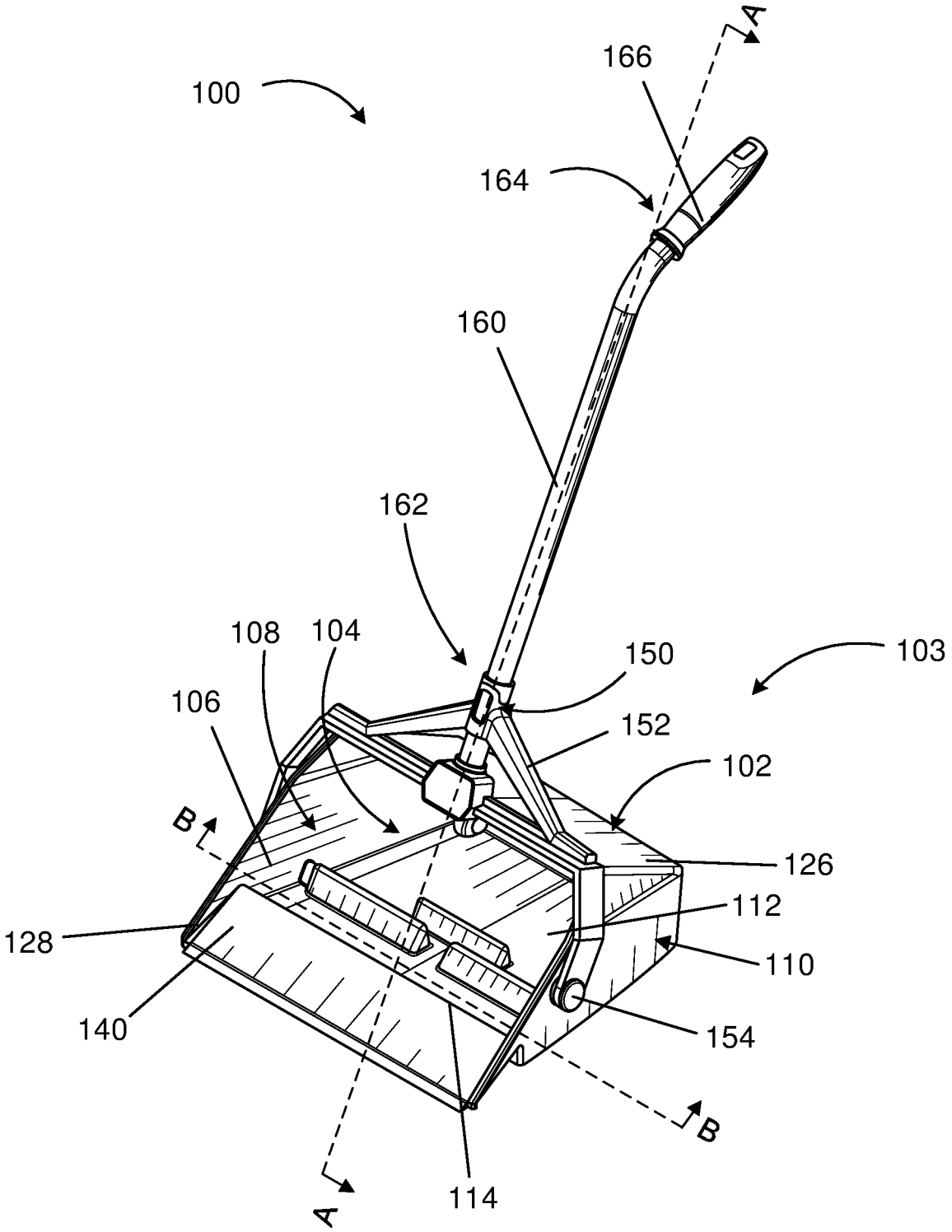
FIG. 1 is a perspective view of a debris pan assembly.
Figure 2:
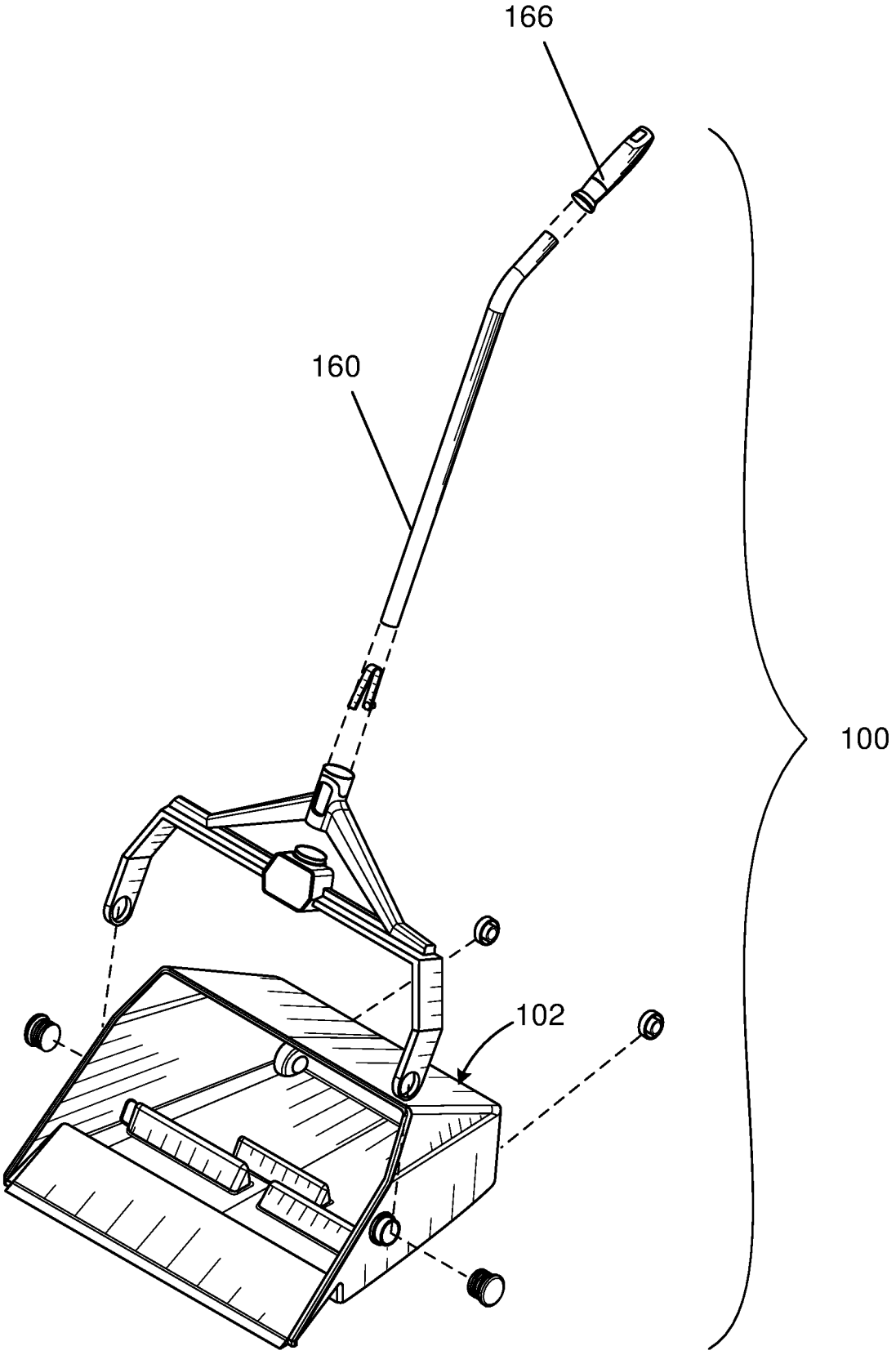
FIG. 2 is an exploded perspective view of the debris pan assembly of FIG. 1.
Figure 3:
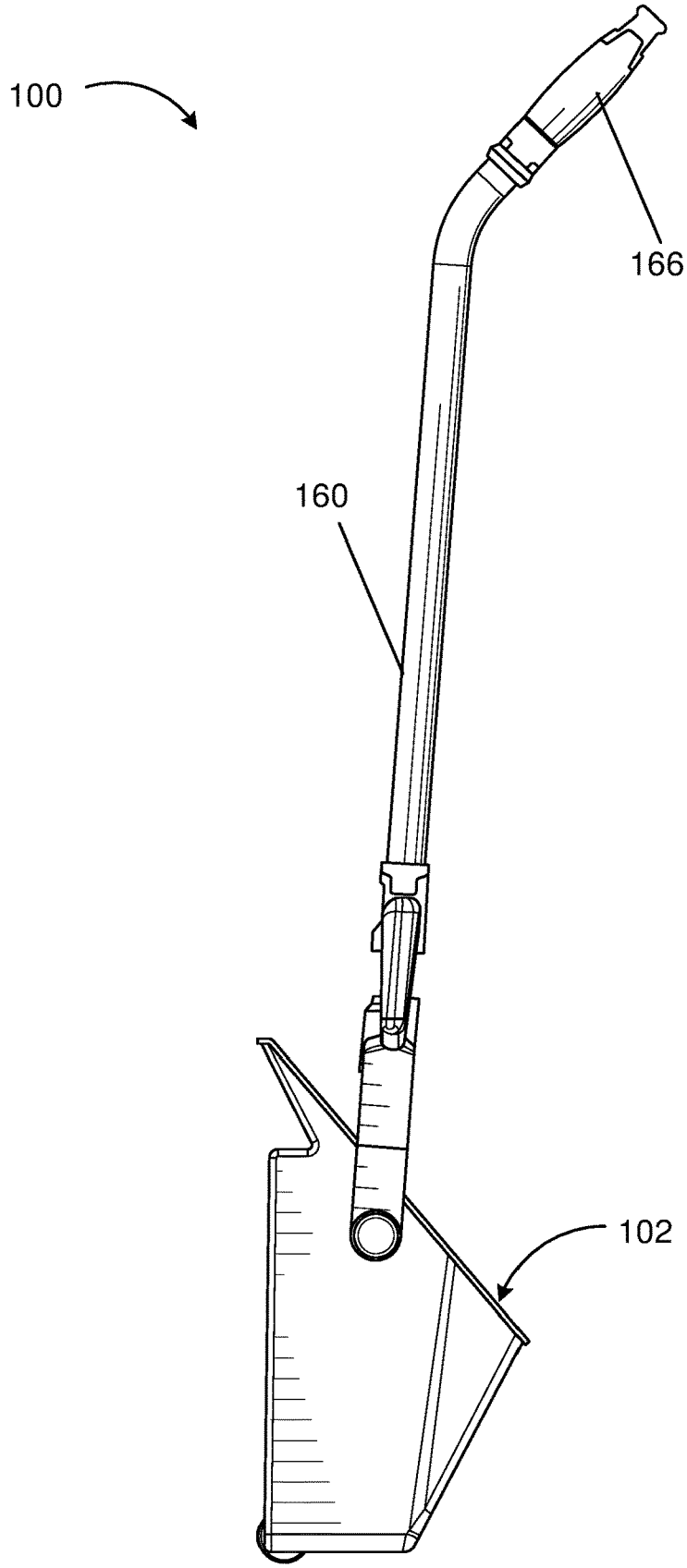
FIG. 3 is a side view of the debris pan assembly of FIG. 1.
Figure 4:
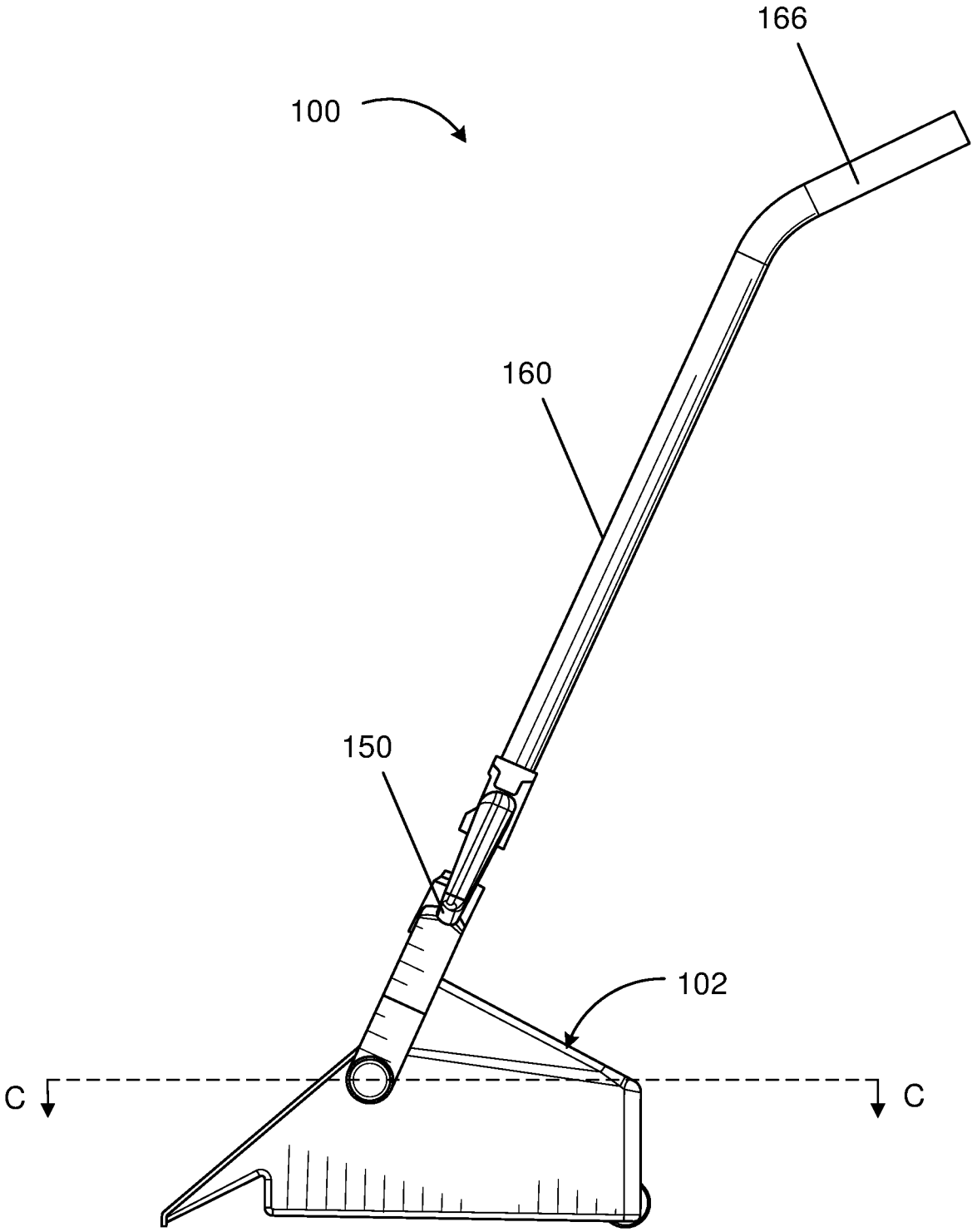
FIG. 4 is a side view of the debris pan assembly of FIG. 1.

Various debris pans (i.e., dustpans) are provided herein. In some embodiments, as shown in FIG. 1, the debris pan 103 includes a bin 102 having a closed interior 104 for containing debris, the closed interior 104 being defined by at least one sidewall 106, and an open end 108 for receiving debris therethrough. As used herein, the phrase "bin" refers to an open container. In one embodiment, as shown in FIG. 1, the bin 102 includes a floor 112, a front ledge 114, an outer surface 110, at least one sidewall 106, and an open end 108 for receiving debris. In some instances, the bin's cross-section in the lateral and/or horizontal directions may be substantially rectangular and the open end 108 may define a rectangular rim 128. In other instances, the bin and/or rim may be another shape. The rim 128 and bin 102 may be of any suitable size and shape. The bin 102 internal volume may have a rectangular prism shape, a trapezoidal prism, or a rounded rectangular prism shape, among others.

In some embodiments, the bin 102 includes at least one sidewall 106, a floor 112, and a ceiling 126 to define the closed interior 104 and an open end 108. For example, the bin 102 may have one or more walls configured to contain debris and other substances. In certain embodiments, as shown in FIG. 1, the bin 102 includes five walls (e.g., a floor 112, a ceiling 126, two opposed sidewalls, and a rear sidewall). In other instances, the bin 102 may include fewer than five walls. That is, the bin 102 may be semi-spherical with one wall or the bin 102 may be another shape with more than five walls. In some instances, the bin 102 walls may be integrally or continuously formed with or without distinct edges or are otherwise coupled together. In certain embodiments, the walls of the bin 102 may form other components within the closed interior 104.

Figure 7:
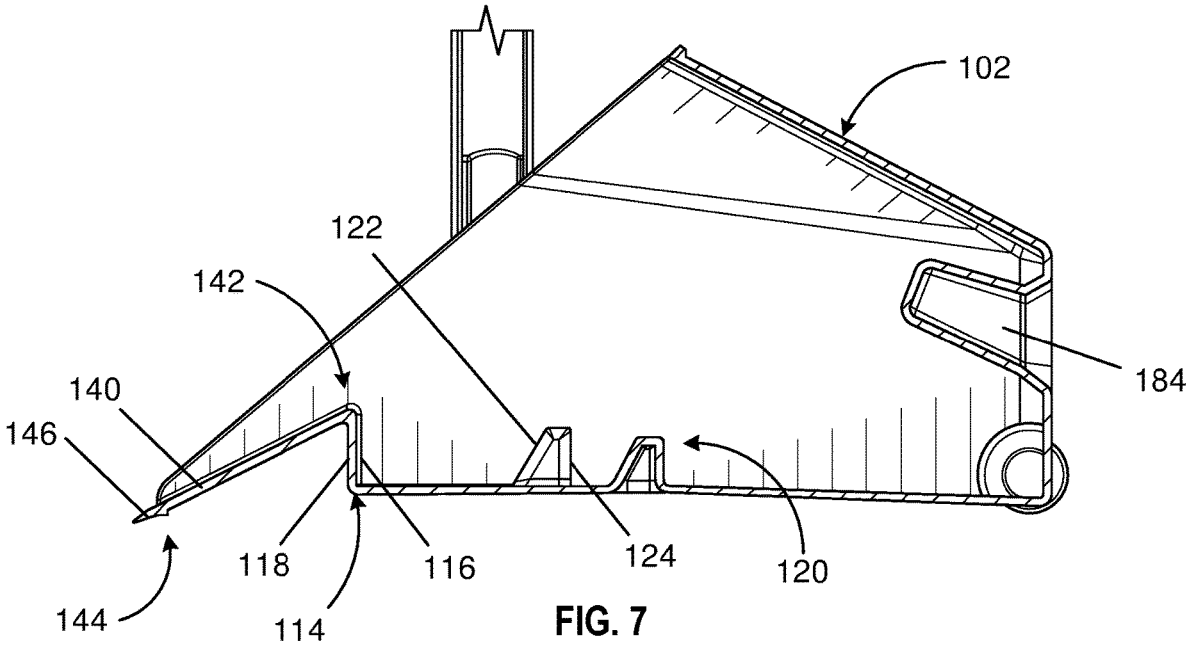
FIG. 7 is a cross-sectional side view of the bin taken along line A-A of FIG. 1.

In some embodiments, as shown in FIGS. 1 and 7, the bin 102 includes a ramp 140 extending on one end of the bin 102. The ramp 140 may be raised from one surface of the bin 102 walls at an angle. For example, the ramp 140 may include a front ledge 114 disposed between the floor 112 and the ramp 140 that forms a partial sidewall defining the closed interior 104 of the bin 102. In some instances, the ramp 140 may be angled away from the front ledge 114 towards the ground. That is, the front ledge 114 may form a 90 degree angle with the floor 112 and the ramp 140 may extend at a degree towards the ground and away from the front ledge 114. In this manner, the ramp 140 may be configured to capture debris from the ground that is swept into the bin 102. For example, the front ledge 114 may include a front face 116 and a rear face 118 (e.g., as shown in FIG. 7). That is, the front face 116 may be exposed to the closed interior 104, and the rear face 118 may be exposed to the outer surface 110. The front ledge 114 may be disposed on a first end 142 of the ramp 140, and the ramp 140 extends away from the first end 142. In this manner, the ramp 140 may include an opposed second end 144 opposite the first end 142. For example, the front ledge 114 may connect to the floor 112 and one or more sidewalls of the bin 102 and define the uppermost edge of the ramp 140.

Figure 5:
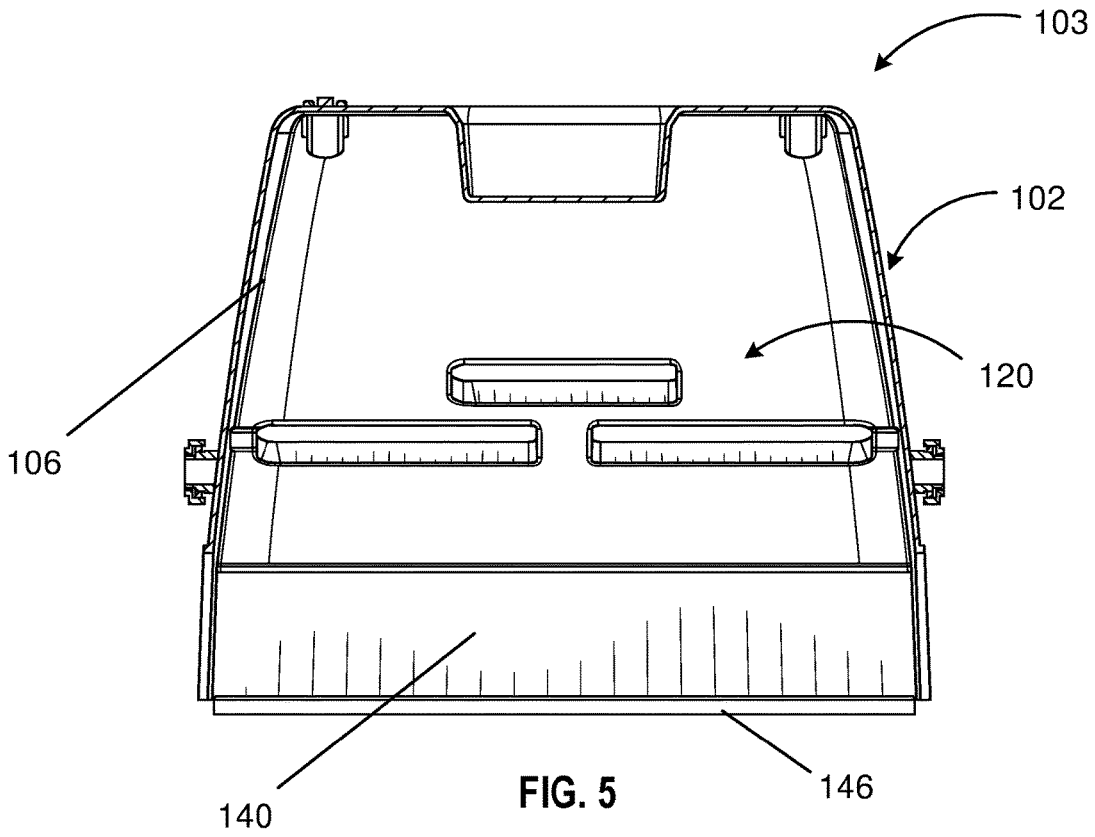
FIG. 5 is an inside sectional view of the bin of the debris pan taken along line C-C of FIG. 4.
Figure 6:
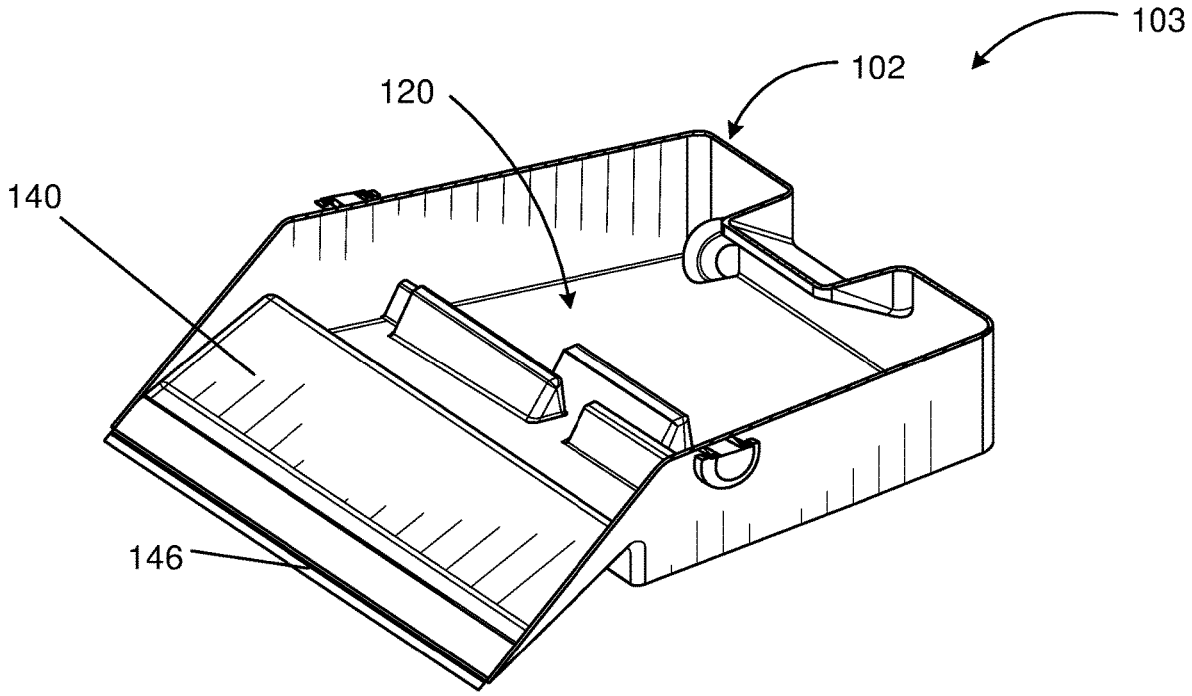
FIG. 6 is a perspective inside sectional view of the bin taken along line C-C of FIG. 4.

In some embodiments, as shown in FIGS. 5-7, the ramp 140 includes a flexible lip 146 extending from the second end 144 of the ramp 140 opposite the first end 142. For example, the lip 146 may be made of a separate material than that of the bin 102, such as a metal alloy or plastic, such as thermoplastic. The lip 146 may provide the ramp 140 with a seal to the ground beneficial for maximizing that amount of material to be swept onto the ramp 140 and into the bin 102. In some embodiments, the bin 102 includes an 18-inch pan opening. In other embodiments, the bin 102 opening may be of varying lengths and widths.

Debris Pan Baffles

In certain embodiments, as shown in FIGS. 5-12, the debris pan 103 includes a plurality of baffles 120 protruding from the bin floor 112. At least two of the baffles 120 may extend from separate opposed sidewalls 106 of the bin 102. That is, at least two of the baffles 120 may form a continuous connection to a sidewall 106 of the bin 102. The plurality of baffles 120 may be disposed or configured in various suitable formations within the bin 102. For example, the baffles 120 may be configured (e.g., sized, shaped and located) to slow liquids from escaping the bin 102. The baffles 120 may be in the shape of rectangular prisms, triangular prisms, or trapezoidal prisms, among others. In certain embodiments, as shown in FIGS. 5-12, the baffles 120 are staggered so liquid movement slows before reaching the front ledge 114 of the bin 102. In certain embodiments, as seen in FIG. 7, two or more of the baffles 120 may be of different length, width, and height. For example, the baffles 120 may be of any appropriate size. The baffles 120 generally have a first surface 122 facing the open end of the bin 102 as well as an opposed second surface 124. In certain embodiments, one side of the baffles 120 (e.g., the first surface 122) may be angled at 60 degrees relative to the floor 112. In other embodiments, the baffles 120 may each be angled at greater than or less than 60 degrees relative to the floor 112. The baffles 120 may be angled relative to the floor 112 on one or more sides. For example, as shown in FIG. 7, the first surface 122 may be angled relative to the floor 112 and face the front face 116 of the front ledge 114. The second opposed surface 124 may be substantially perpendicular to the floor 112. In some instances, the first surface 122 of each baffle in the plurality of baffles 120 may be angled along parallel planes. In other instances, the first surface 122 of each baffle may be angled along planes of different angles relative to the floor. For example, one or more of the baffle faces may be substantially perpendicular to the floor 112.

In certain embodiments, the baffles 120, in combination with the bin 102, may contain (i.e., restrict the flow of) up to 32 liquid ounces. The bin 102, alone or in combination with the baffles 120, may hold more than 32 liquid ounces. For example, the bin 102 may be waterproof, shatterproof, scratch resistant, alone or in combination.

Debris Pan Assemblies

The debris pan assembly may include a bin configured to selectively move and/or rotate to capture debris. For example, the bin may be attached to a pivotal and/or rotatable mechanism configured to utilize the bin in a standing position (e.g., the bin is set on the ground) or a carrying position. That is, the bin may attach to a yoke, a ball joint, a swivel, or some other type of rotatable mechanism configured to position the bin in a particular direction. In some instances, the debris pan assembly may include a bin, a yoke rotatably attached to the bin, an elongated shaft extending from the yoke, and a latch on the bin configured to engage the yoke. In this manner, when the latch is in a first position, the latch may prevent rotational movement of the bin and the yoke. In a second position, the latch may disengage the yoke and allow rotational movement.

In some embodiments, as shown in FIG. 1, the debris pan assembly 100 includes a yoke 150. As used herein, the word "yoke" refers to a mechanism configured to allow rotational or pivotal movement. In some instances, the yoke may be a cross bar configured to secure the debris pan 103 to an elongated shaft 160 or handle. As shown in one embodiment, illustrated in FIG. 1, the yoke 150 includes a central hollow structure capable of receiving a shaft and multiple supporting arms (e.g., at least two arms 152) extending therefrom to connect to the debris pan 103. For example, the arms 152 may couple to spindles 154 at one end, and the bin 102 may rotate upon said spindles 154. In other embodiments, the yoke could mean another mechanism configured to allow pivotal and/or rotational movement of the bin. In some instances, the bin may be pivotal and/or rotational about the handle or the elongated shaft. In certain embodiments, the yoke may be a ball joint, a swivel, or other pivotal mechanism. In other embodiments, the bin may be rigidly attached to the handle or the elongated shaft.

Figure 13:
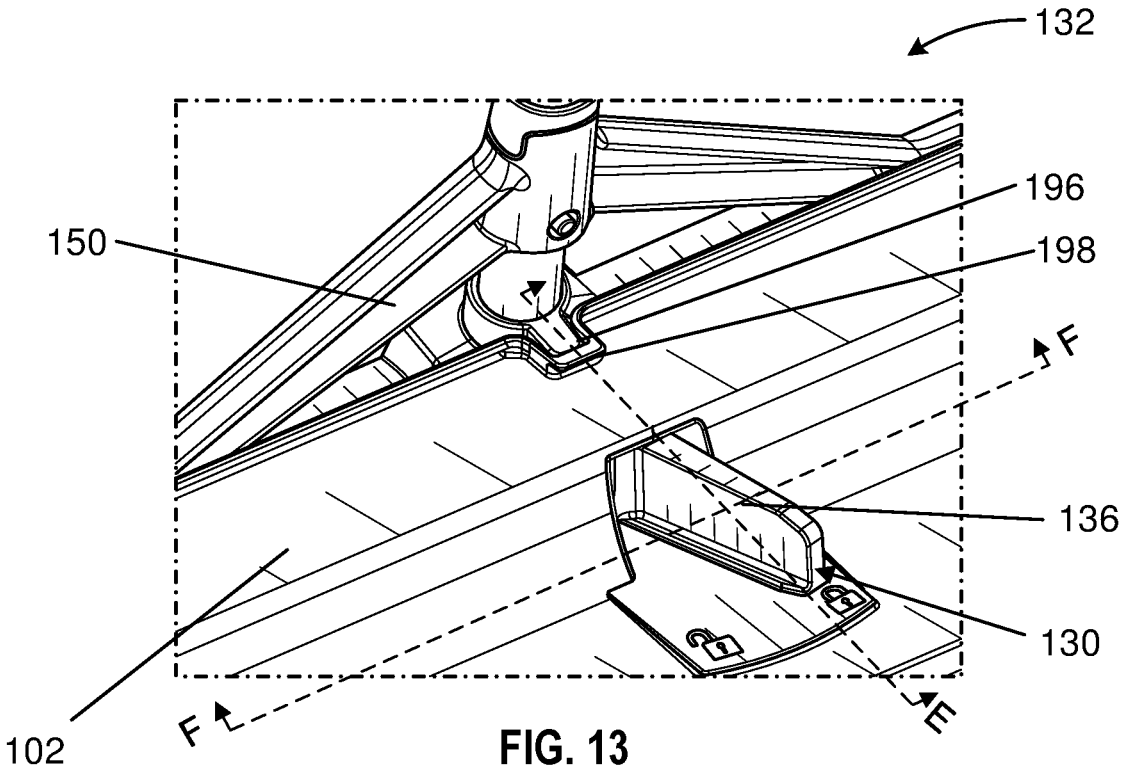
FIG. 13 is a partial rear view of one embodiment of a latch mechanism of the debris pan assembly of FIG. 1 in a locked position.
Figure 14:
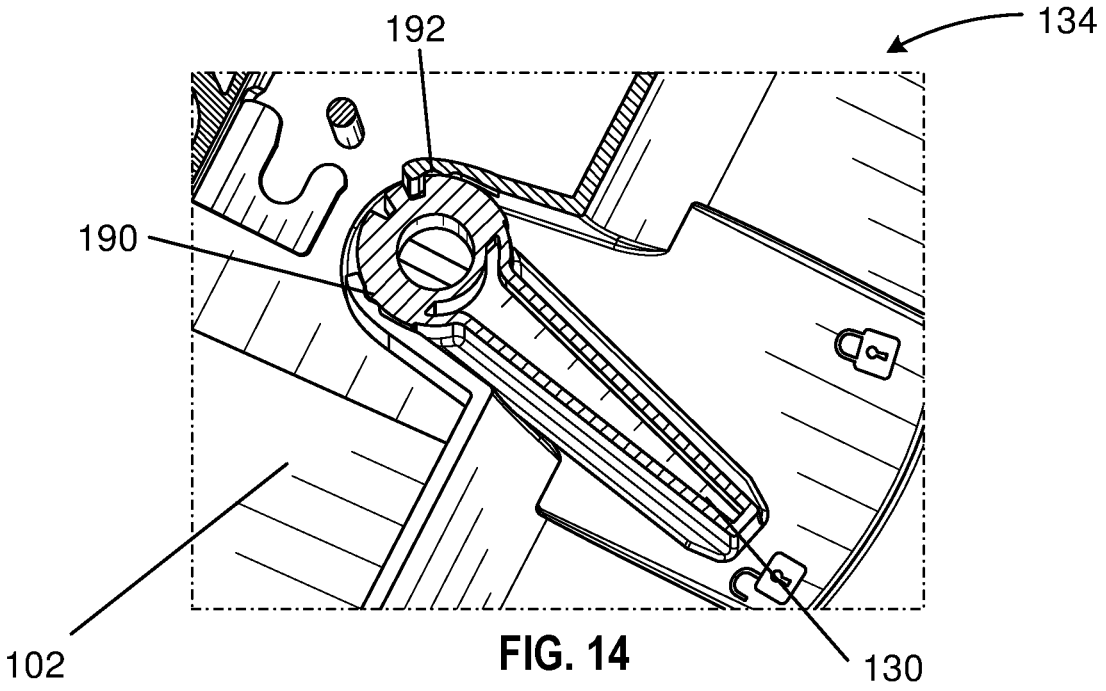
FIG. 14 is a top cross-sectional view taken along line F-F from FIG. 13 of the latch mechanism in an unlocked position.
Figure 22:
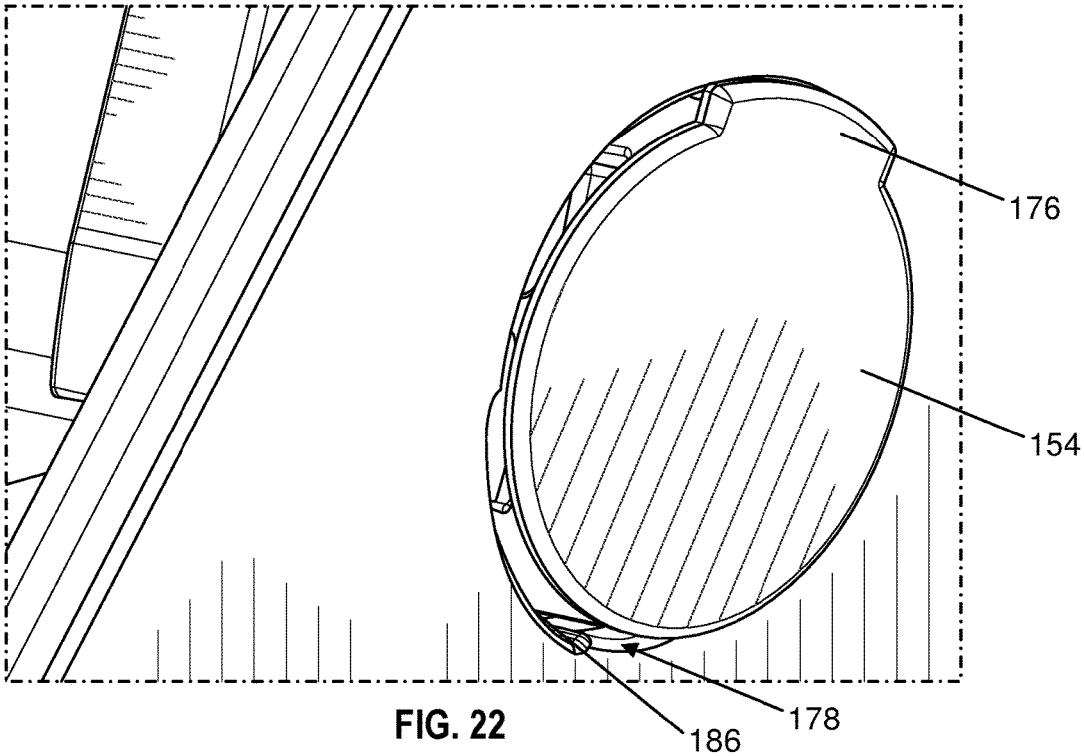
FIG. 22 is a side view of the spindle of FIG. 19.
Figure 23:
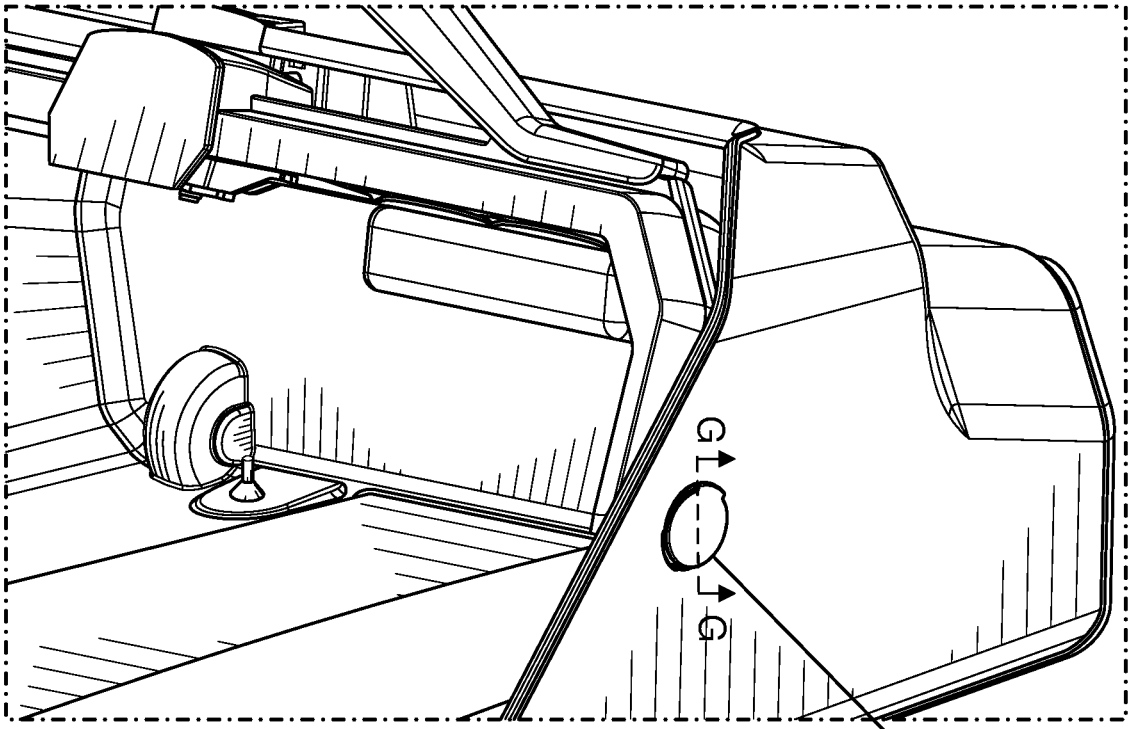
FIG. 23 is a perspective front view of the spindle and the bin of FIG. 19.
Figure 24:
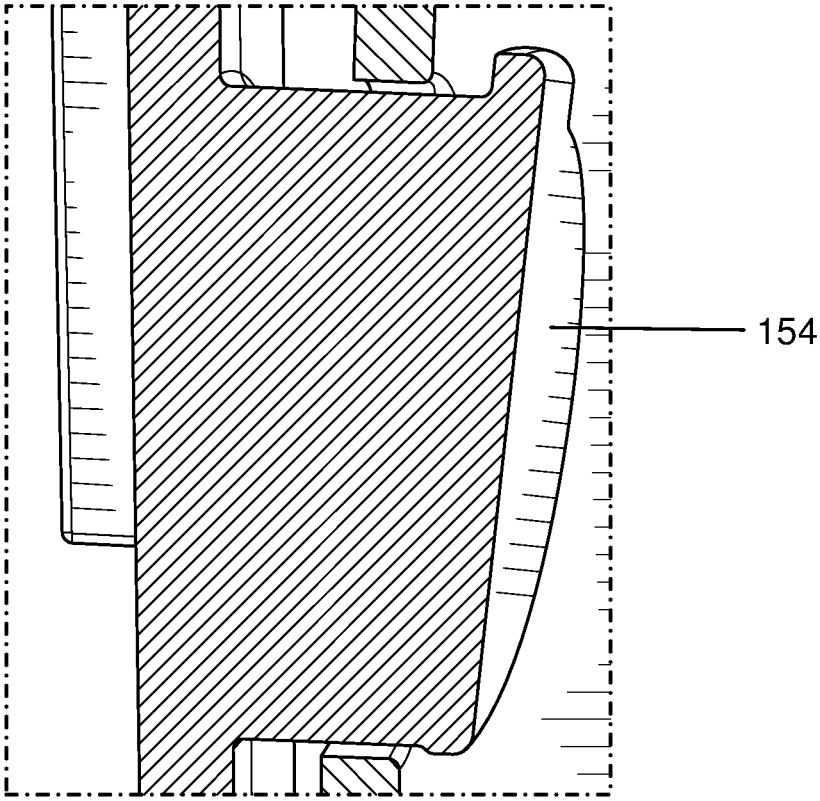
FIG. 24 is a cross-sectional view of the spindle taken along line G-G of FIG. 23.
Figure 25:
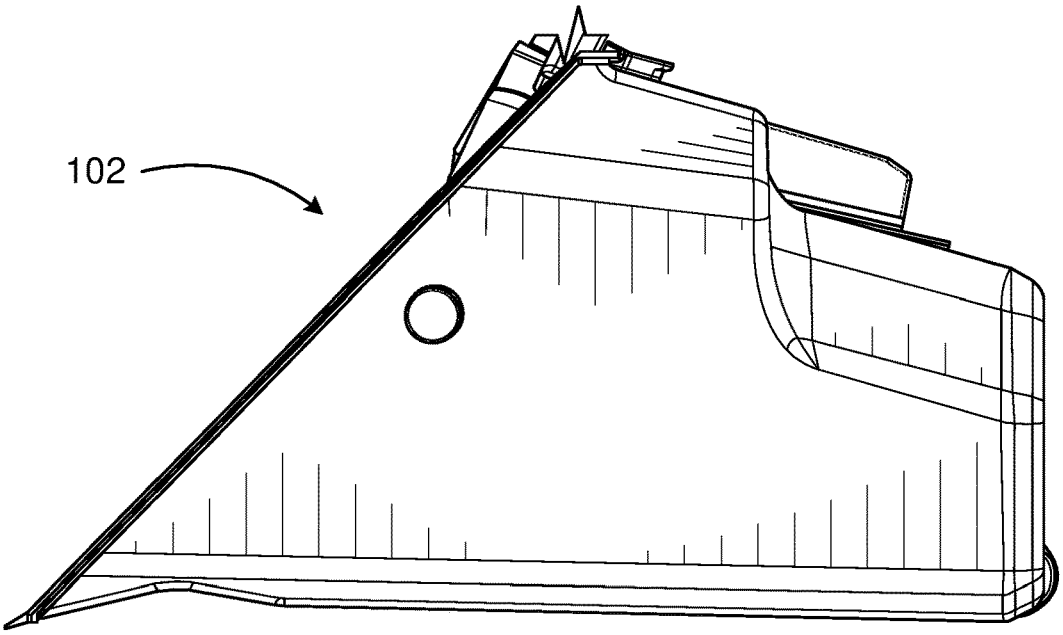
FIG. 25 is a side view of the bin of FIG. 19.

In certain embodiments, as shown in FIGS. 1, 19-20, and 22-24, the debris pan assembly includes at least one spindle 154 and at least two arms 152. For example, at least two arms 152 of the yoke 150 each may have at least one spindle 154. The yoke 150 may be coupled to the bin 102 by the spindle 154 extending from each of the arms 152. In one embodiment, as shown by FIG. 22, the spindle 154 connects to the bin 102 by protruding through sidewalls 106 on the bin 102. That is, the at least one sidewall 106 of the bin 102 may include one or more sidewall apertures 178 (e.g., as shown in FIG. 22) to receive the spindle(s) 154. In some instances, at least one spindle 154 may include a locking detent 176 configured to selectively engage a locking surface 186 within the sidewall aperture 178 on the bin 102. In other instances, the spindle(s) 154 may freely rotate within the sidewall aperture 178 on the bin. The sidewall apertures 178 and the spindle(s) 154 may be configured to permit movement (i.e., rotation about the spindle 154 of the bin 102) or restrict movement in coordination with a latch 130 (e.g., as shown in FIG. 13). For example, as will be described in more detail, the spindle 154 may permit rotation of the bin 102 when the latch 130 is not engaged in its first position 132 (i.e., locking position). In certain embodiments, the yoke 150 includes two spindles 154 to allow movement of the bin 102 when the latch 130 is in the second position 134 (i.e., disengaged or unlocked position).

Figure 31:
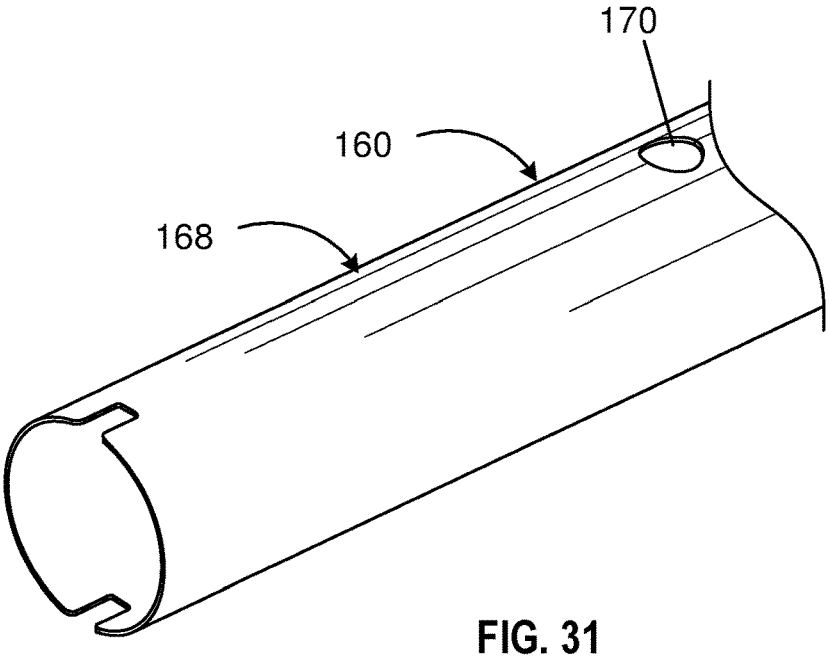
FIG. 31 is a partial perspective view of the elongated shaft of FIG. 29.
Figure 32:
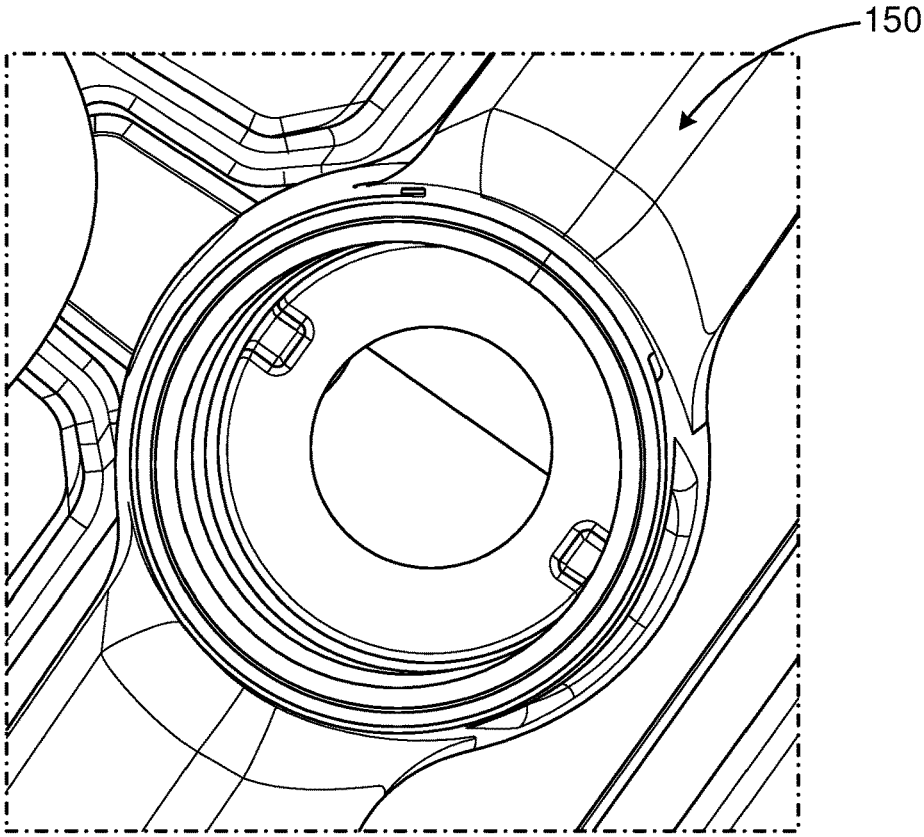
FIG. 32 is a partial top view of the yoke of FIG. 29.

In certain embodiments, as shown in FIGS. 1-4, the debris pan assembly 100 includes an elongated shaft 160. The elongated shaft 160 may be substantially straight or may be another suitable shape. For example, in FIG. 1, the elongated shaft 160 may include a bend near the handle 166. One or both ends of the elongated shaft 160 may couple to another mechanism of the assembly. For example, the elongated shaft 160 may selectively couple to the yoke 150, such as via the push button assembly described below. For example, the elongated shaft 160 may be selectively detachable from the yoke 150 and the bin 102. The elongated shaft 160 may be formed from any suitable material, such as metal alloy, plastics, or some combination therein. In some instances, the elongated shaft 160 may be a hollow tube 168 (e.g., as shown in FIG. 31). In other instances, the elongated shaft 160 may be hollow, solid, or some combination of the two along its length.

In some embodiments, as shown in FIGS. 1-4, a debris pan assembly 100 includes a handle 166 attached to the elongated shaft 160 at an end opposite the bin 102 (e.g., the first end 164). For example, the handle 166 may have any suitable size and shape to facilitate handling a selectively rotatable bin. In certain embodiments, the handle 166 is cylindrical and includes a frictional gripping material forming a surface thereof. For example, the handle 166 may be formed from any suitable material having a desired grip such as metals and plastics, including thermoplastics. In certain embodiments, the handle 166 includes a bore (not shown) configured to receive the elongated shaft 160.

Figure 29:
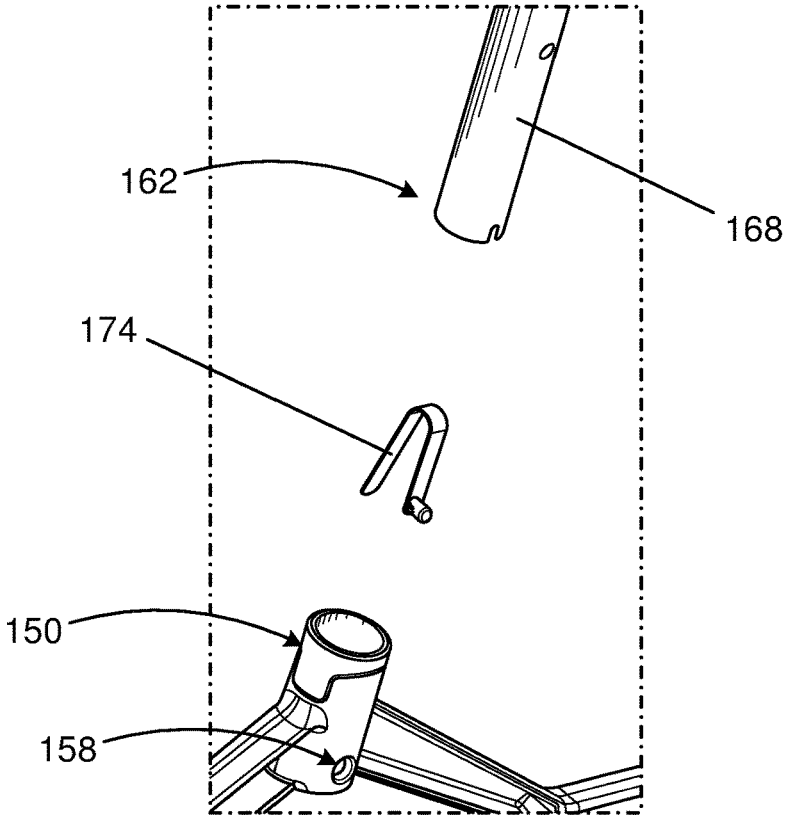
FIG. 29 is an exploded view of one embodiment of an elongated shaft, a push-button, and a yoke of the debris pan assembly of FIG. 1.
Figure 30:
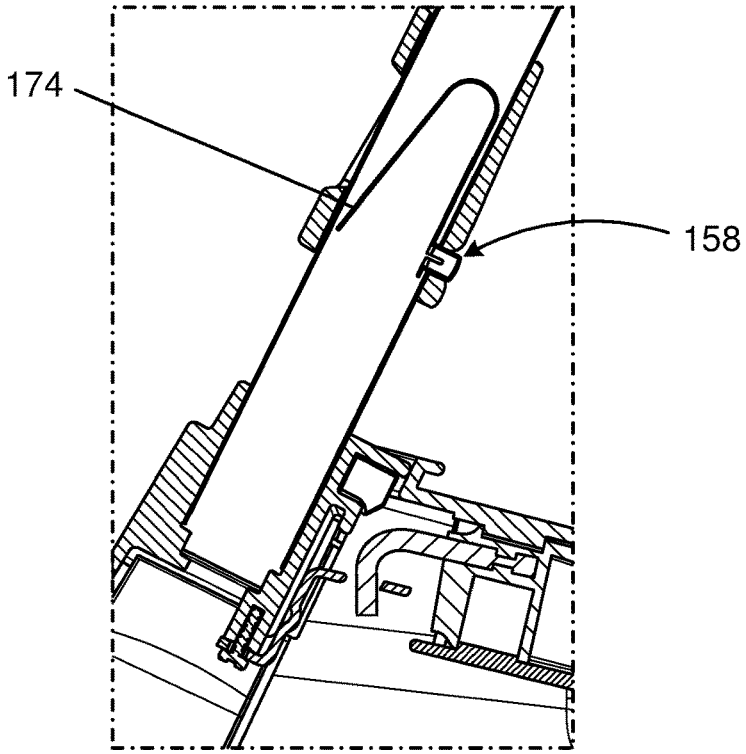
FIG. 30 is a partial cross-sectional view of the elongated shaft, the push-button, and the yoke of FIG. 29.

In certain embodiments, as shown in FIGS. 29 and 30, the debris pan assembly 100 includes a push-button spring 174. As used herein, a "button spring" or "push-button spring" refers to a spring coupled to a protrusion. The "button," as used herein, is the protrusion on the push-button spring 174. In one embodiment, as shown in FIG. 29, the push-button spring 174 is a compression spring coupled to a protrusion that is configured to engage with a yoke aperture 158. For example, the push-button spring 174 can be inserted into the elongated shaft 160 to engage a yoke aperture 158 at the opposed second end 162. In some instances, the elongated shaft 160 may be a hollow tube 168 configured to receive the push-button spring 174. In other instances, the elongated shaft 160 may be a solid tube or some other geometric shape therein. As shown in FIG. 29, the push-button spring 174 protrusion penetrates the elongated shaft 160 and the yoke 150 to form a connection between the two pieces. For example, the push-button spring 174 can be pressed by the button to release the elongated shaft 160 from the yoke 150 and thereby take apart the debris pan assembly 100.

Figure 26:
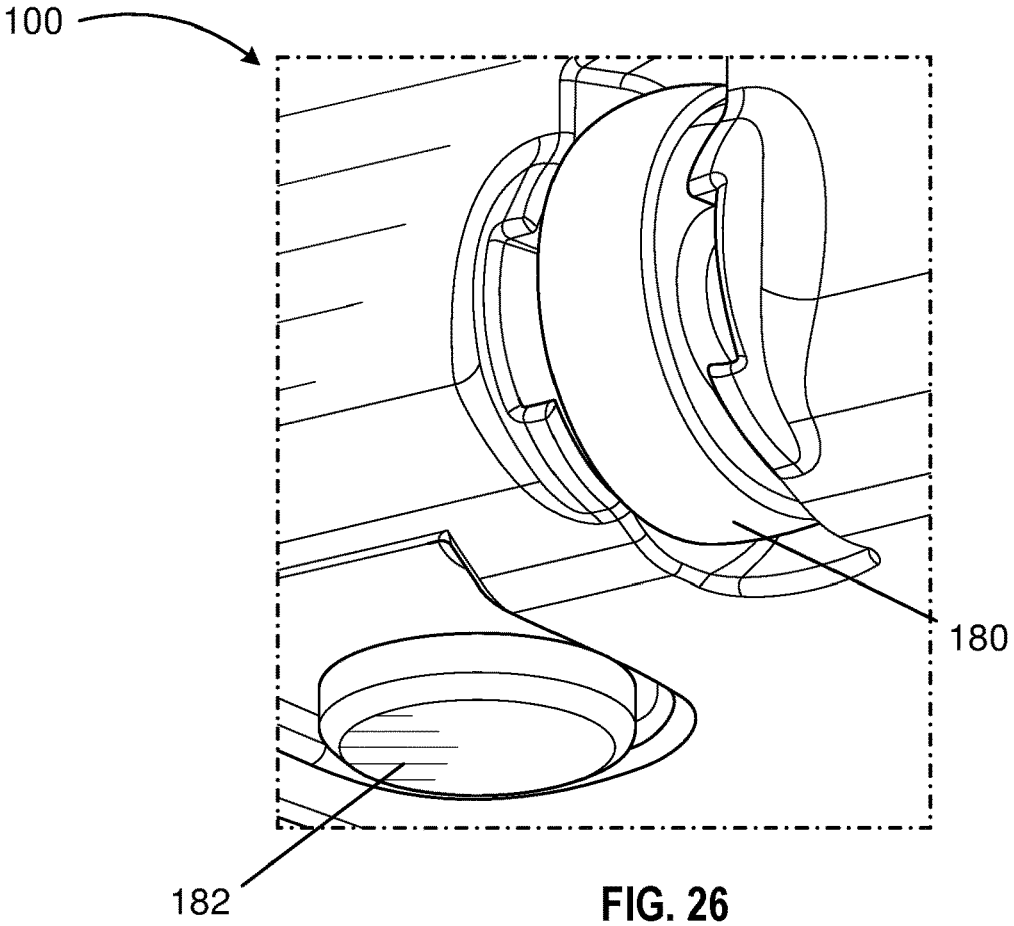
FIG. 26 is a partial underside view of one embodiment of the bin having a bumper and a wheel.
Figure 27:
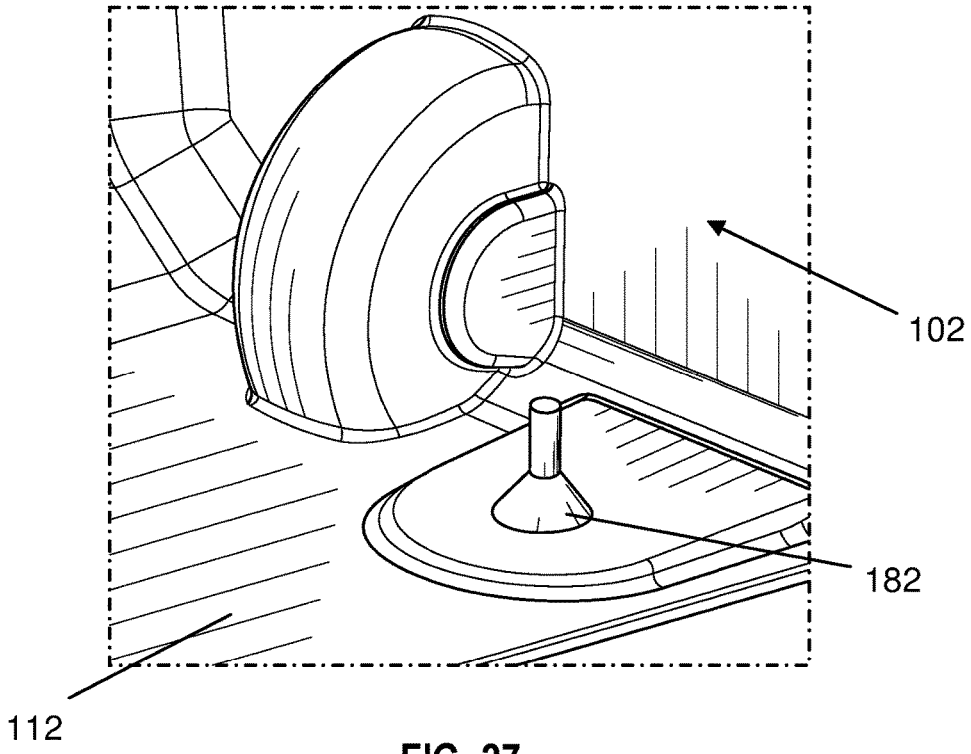
FIG. 27 is an internal view of one embodiment of the bin of FIG. 26.
Figure 28:
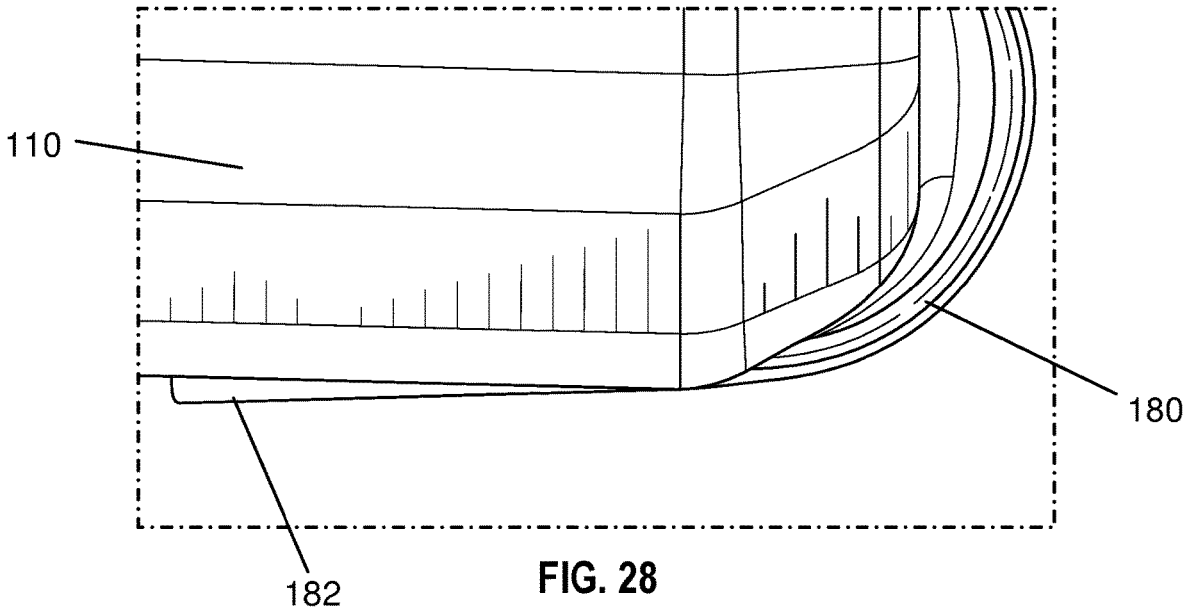
FIG. 28 is a partial side view of the bin of FIG. 26.

In some embodiments, as shown in FIGS. 26-28, the debris pan assembly 100 includes at least one wheel 180. In some instances, as shown in FIG. 27, the bin 102 may include an inner surface to complement the shape of the at least one wheel. For example, the at least one wheel may attach to the bin 102 on an outer surface 110 (i.e., opposing the closed interior 104) thereof. In one embodiment, as shown in FIG. 5, the debris pan assembly 100 includes two wheels 180 attached at the rear corners of the bin 102. For example, the at least one wheel may be attached to the outside of the bin 102 walls or another beneficial position on the debris pan. For example, the wheels 180 may be positioned such that the bin 102 must be rotated relative to the elongated shaft 160 for the wheels 180 to engage with a surface.

Figure 8:
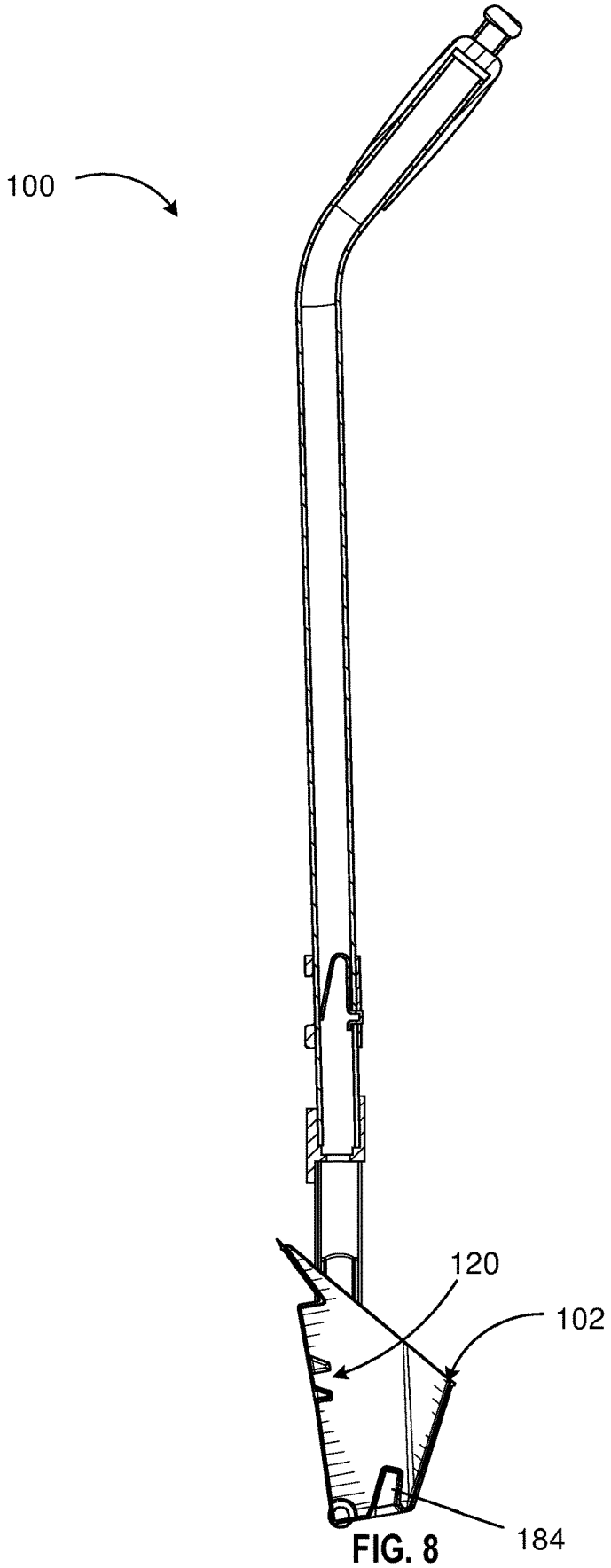
FIG. 8 is a cross-sectional side view of the debris pan assembly taken along line A-A of FIG. 1.
Figure 9:
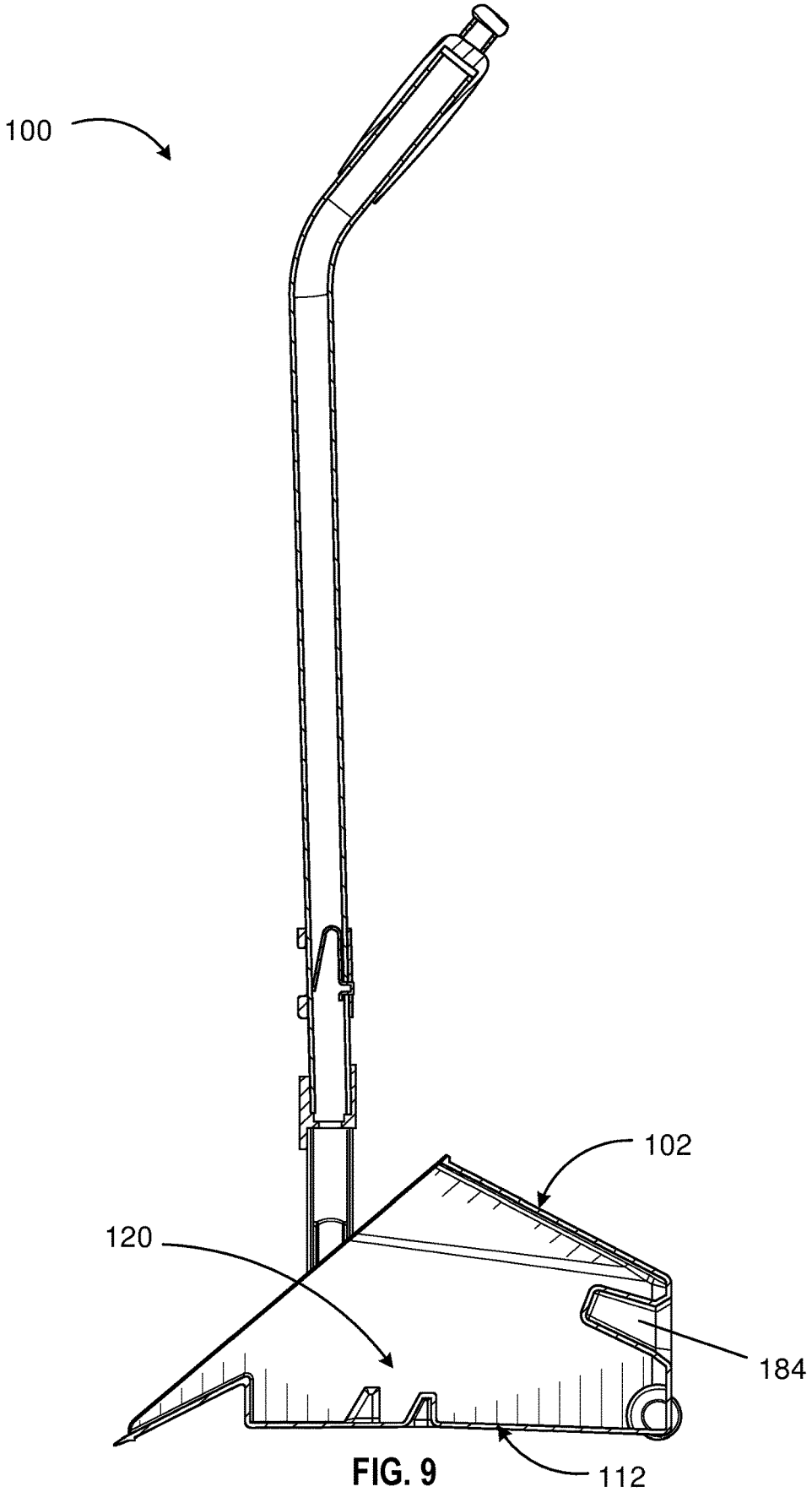
FIG. 9 is a cross-sectional side view of the debris pan assembly taken along line A-A of FIG. 1.
Figure 10:
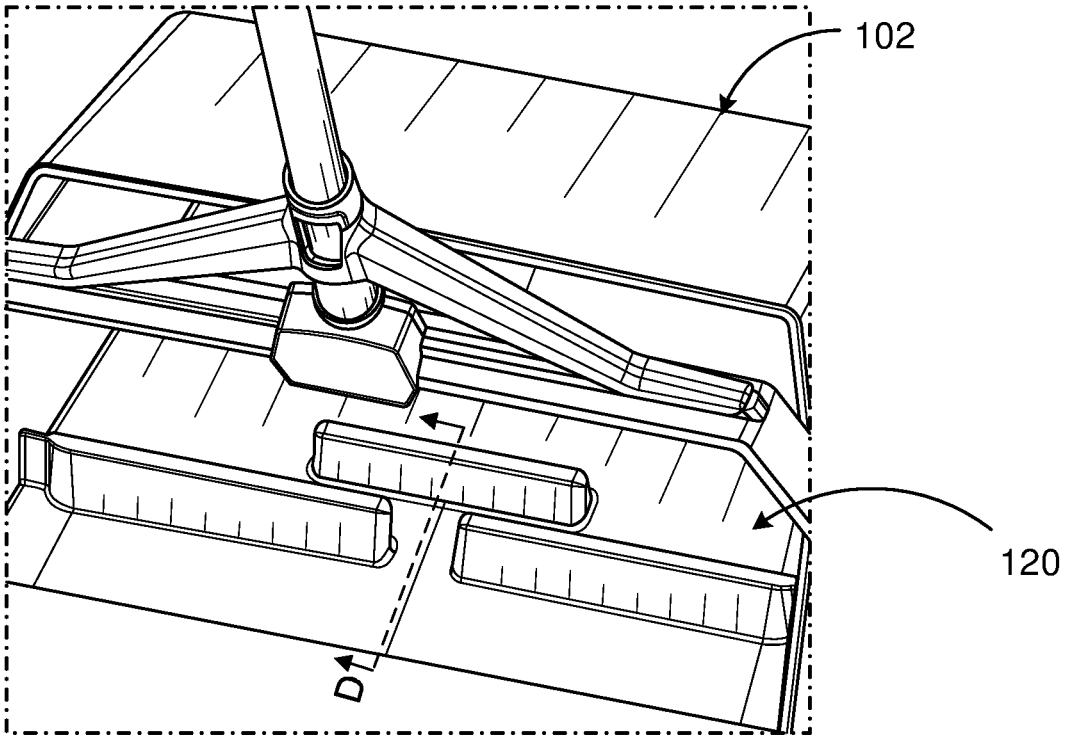
FIG. 10 is a partial upper perspective view of the bin and the yoke of the debris pan assembly of FIG. 1.
Figure 11:
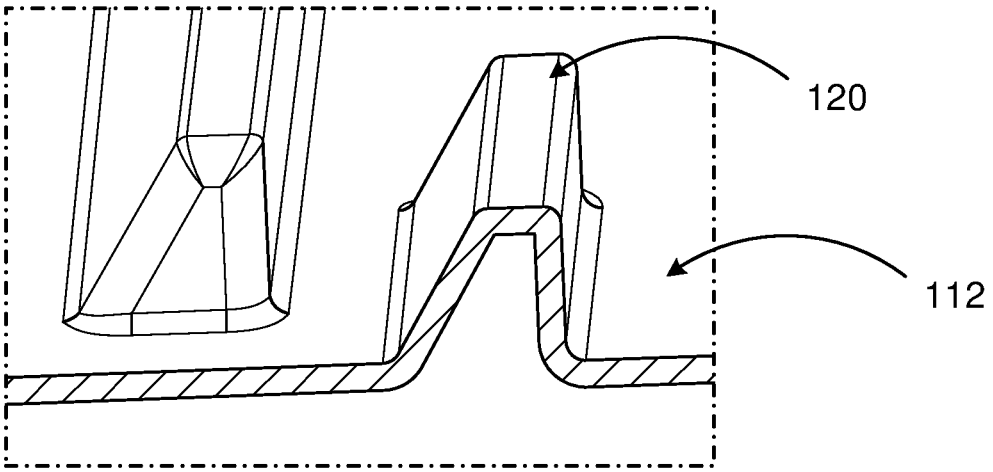
FIG. 11 is a partial cross-sectional view of one embodiment of a plurality of baffles of the bin taken along line D-D of FIG. 10.
Figure 12:
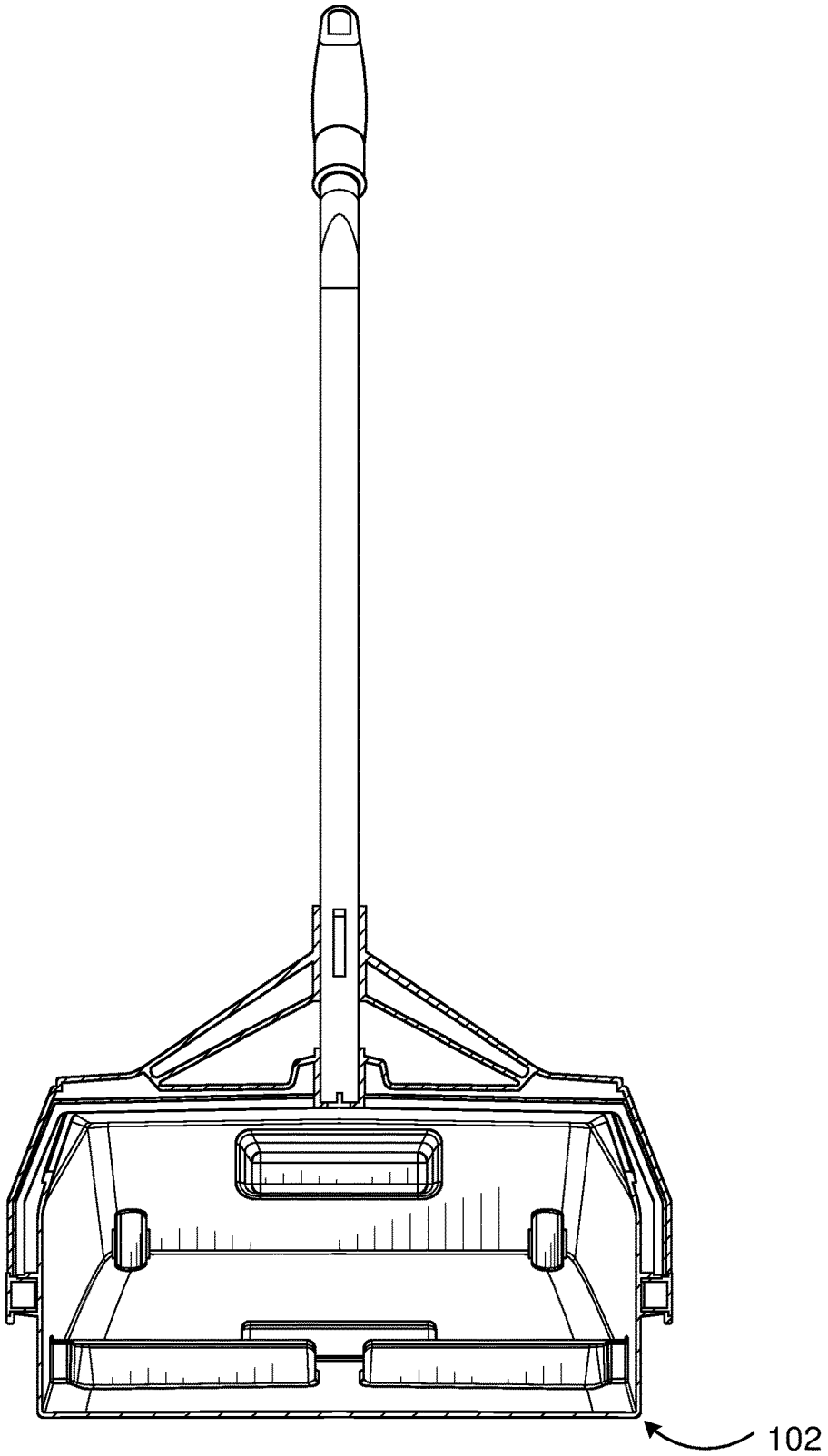
FIG. 12 is a cross-sectional front view of the debris pan assembly taken along line B-B of FIG. 1.

In certain embodiments, as shown in FIGS. 7-9, the bin 102 includes a channel 184 on at least one sidewall 106 of the bin 102. For example, the channel 184 may be an inward protrusion into the bin 102 from the outer surface 110. That is, the channel 184 opening may begin on the outer surface 110 of the bin 102 and extend into the closed interior 104. The channel 184 may be configured and useful for receiving a user's fingers, such as to assist with waste disposal from the debris pan.

In certain embodiments, as shown in FIGS. 26 and 27, the debris pan assembly includes at least one bumper 182 help keep the bin 102 from sliding across a surface. In one embodiment, as shown in FIGS. 26 and 27, the bumper 182 is coupled to the bin 102 by a shaft thereof extending through the bin 102 and being secured thereto. For example, the bumpers may be made of plastic, rubber, metal alloy, or other material. The bumper surface configured to contact a surface may be circular, rectangular, or another suitable shape and size. In one embodiment, as shown in FIG. 28, the one or more bumpers 182 attached to the bin 102 may extend further away from the floor 112 of the bin 102 than the one or more wheels 180.

Debris Pan Latch

In some embodiments, as shown in FIGS. 13-18, the debris pan assembly includes a latch 130. In some instances, the latch 130 may be coupled to the bin 102, such that the latch 130 is selectively pivotable between a first position 132 (i.e., locked position) in which the latch 130 engages the yoke 150 such that the bin 102 and the yoke 150 are rigidly positioned relative to one another, and a second position 134 (i.e., unlocked position) in which the bin 102 and the yoke 150 are not rigidly positioned relative to one another (e.g., such that the bin 102 is freely rotatable about the spindles 154). In some instances, the latch 130 includes a grip 136. That is, the grip 136 may be configured to be grappled by a user to adjust the latch 130 between the first position 132 and the second position 134.

Figure 17:
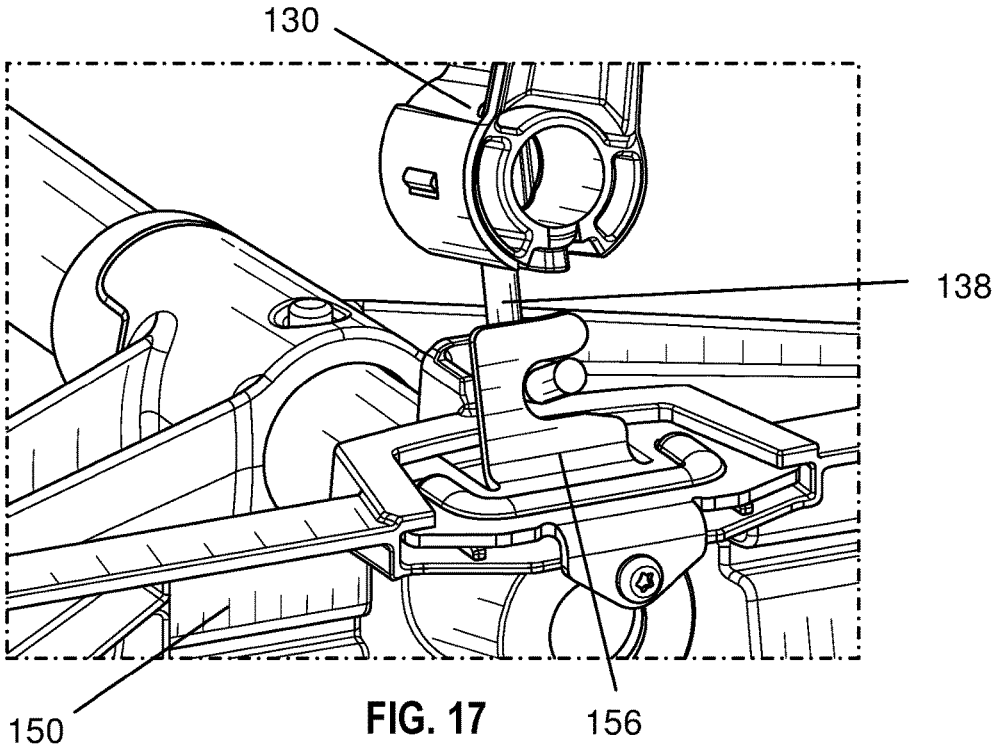
FIG. 17 is a partial bottom view of the latch mechanism of FIG. 15 in the locked position.
Figure 18:
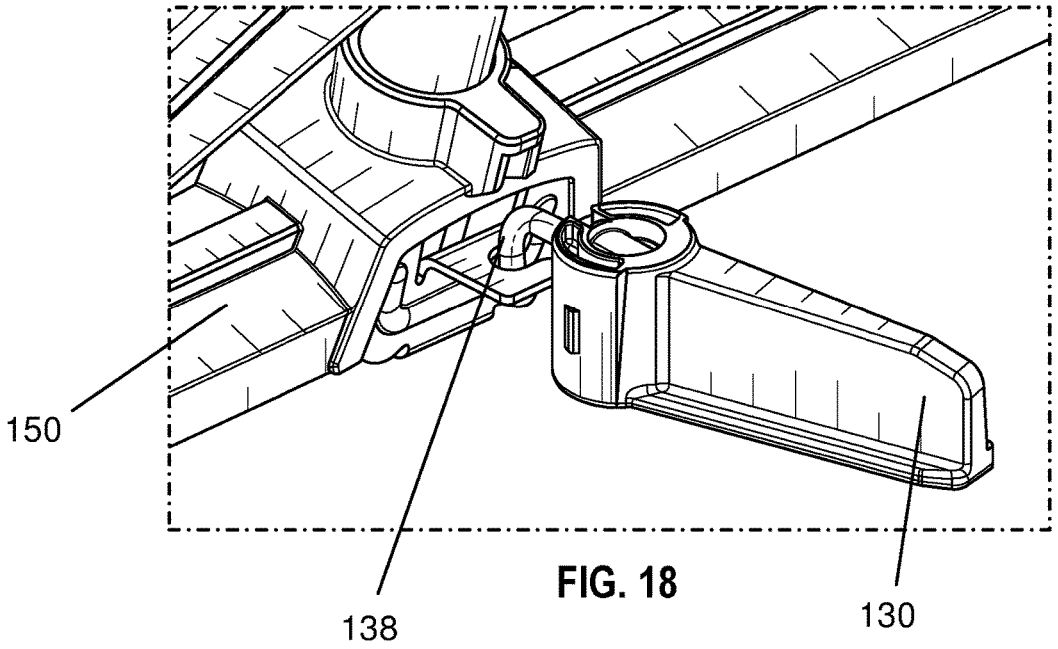
FIG. 18 is a perspective view of the latch mechanism of FIG. 15 in the locked position.
Figure 19:
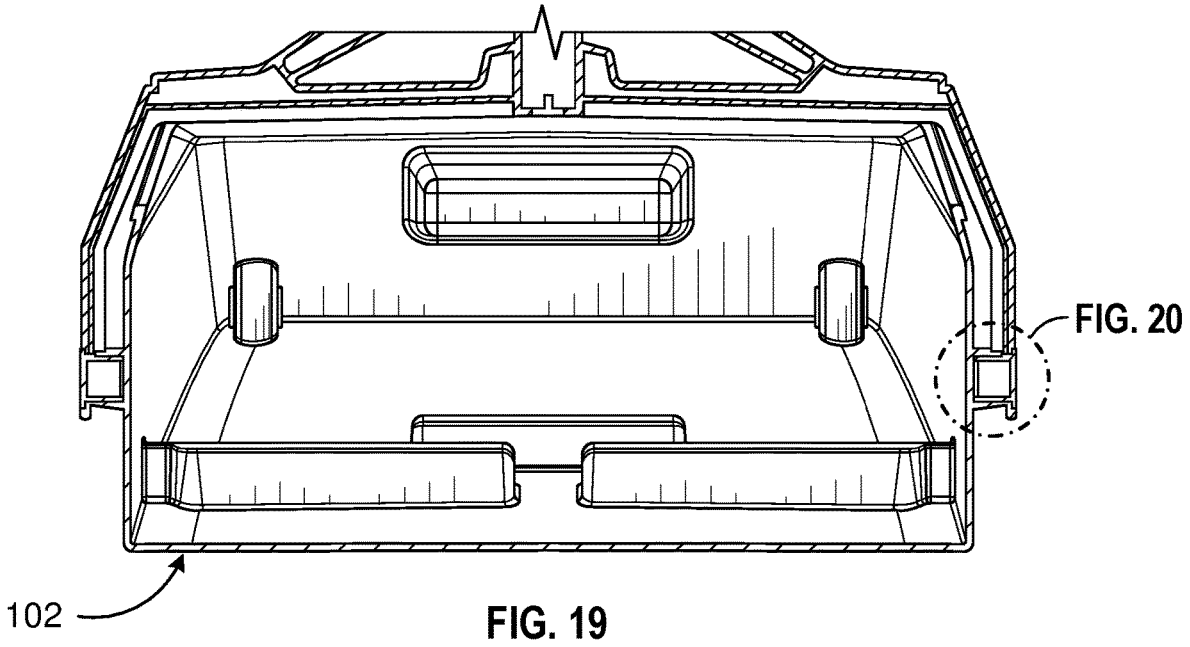
FIG. 19 is a front cross-sectional view of the bin and a spindle of the debris pan assembly of FIG. 1.
Figure 20:
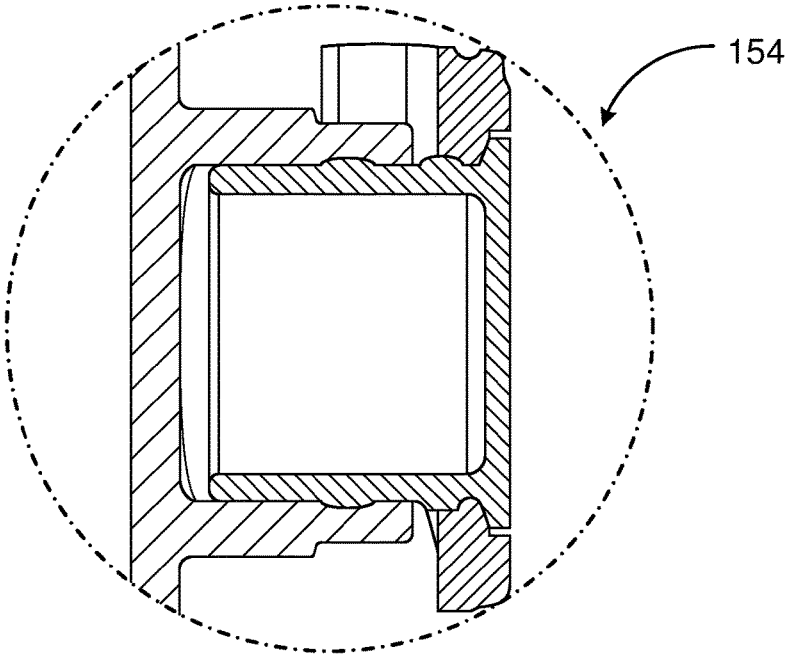
FIG. 20 is a enlarged sectional view of the circled area of FIG. 19 of the spindle.

In one embodiment, as shown in FIGS. 17 and 18, the latch 130 includes a latch connection mechanism 138 configured to pivot between a first position and a second position. In some instances, the latch connection mechanism may be a wire, loop, hook, claw, suction cup, or other mechanism configured to selectively secure the latch. For example, the latch connection mechanism 138 may be a curved wire shaped to engage a hook on the yoke 150. The latch 130 may attach to the bin 102 (e.g., as shown in FIG. 13) and pivot about an axis. For example, the latch connection mechanism 138 of the latch 130 may engage with a hook 156 coupled to the yoke 150 when moved into the first position 132, so as to rigidly fix the bin and the yoke/shaft in positions relative to one another (e.g., with the body of the bin 102 extending generally perpendicularly to the axis of the shaft). The hook 156 may be of varying shapes and sizes, including C-shaped or L-shaped.

Figure 15:
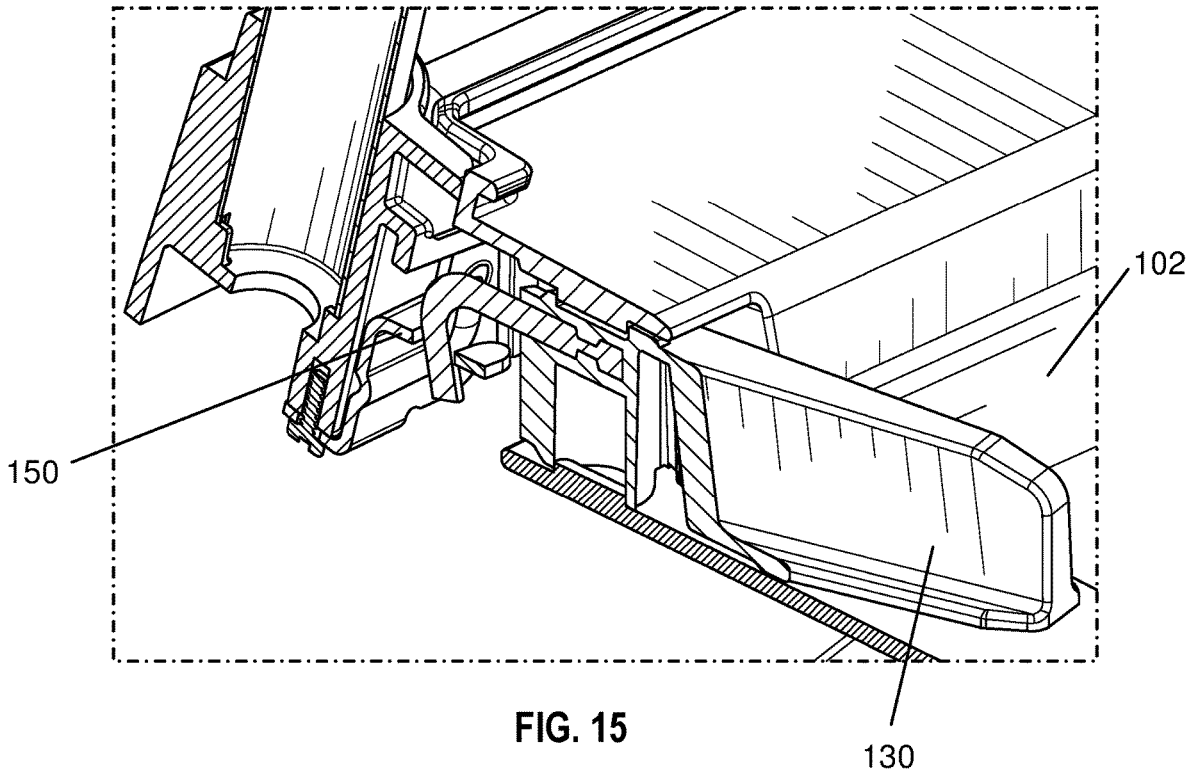
FIG. 15 is a partial cross-sectional view of the latch of the debris pan assembly taken along line E-E of FIG. 13.
Figure 16:
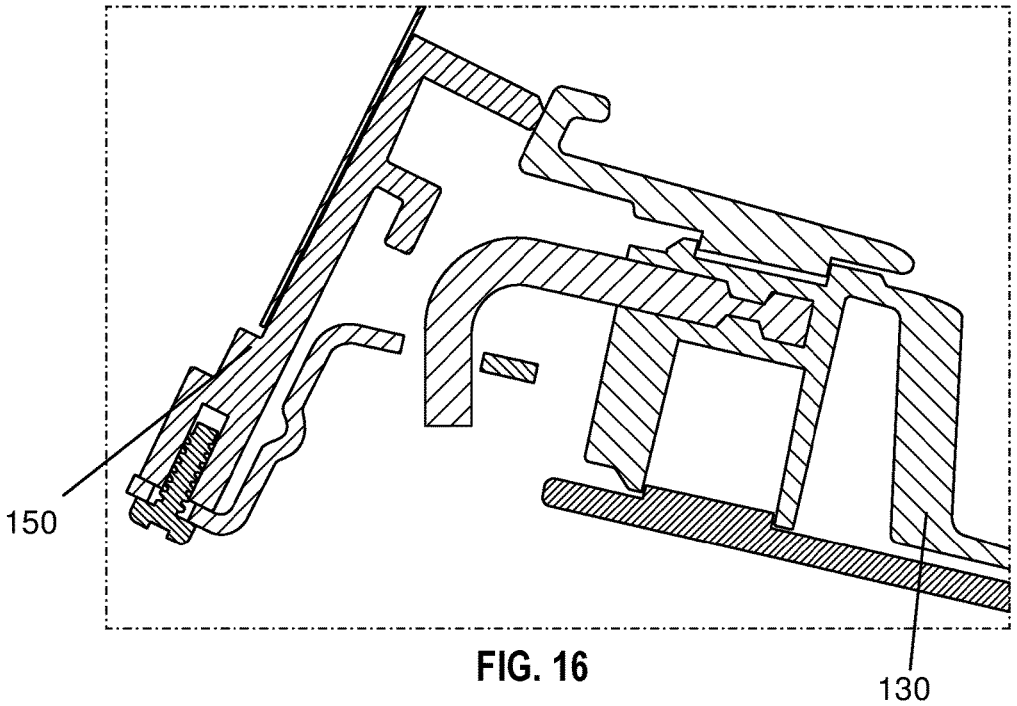
FIG. 16 is a cross-sectional view of the latch taken along line E-E of FIG. 13.

In some embodiments, as shown in FIGS. 13-16, the latch 130 of the debris pan assembly swivels between a first position 132 (i.e., locked position) and a second position 134 (i.e., unlocked position). In some instances, the latch 130 may have more than two positions performing various functions. For example, the latch connection mechanism 138 (e.g., as shown in FIG. 18) of the latch 130 may hold the latch 130 and the bin in place. In other embodiments, as shown in FIG. 15, the latch 130 includes one or more male detents 190, and the bin 102 includes one or more female detents 192. The male detents 190 may engage with the female detents 192 of the bin 102 to secure the latch 130 into place.

Figure 21:
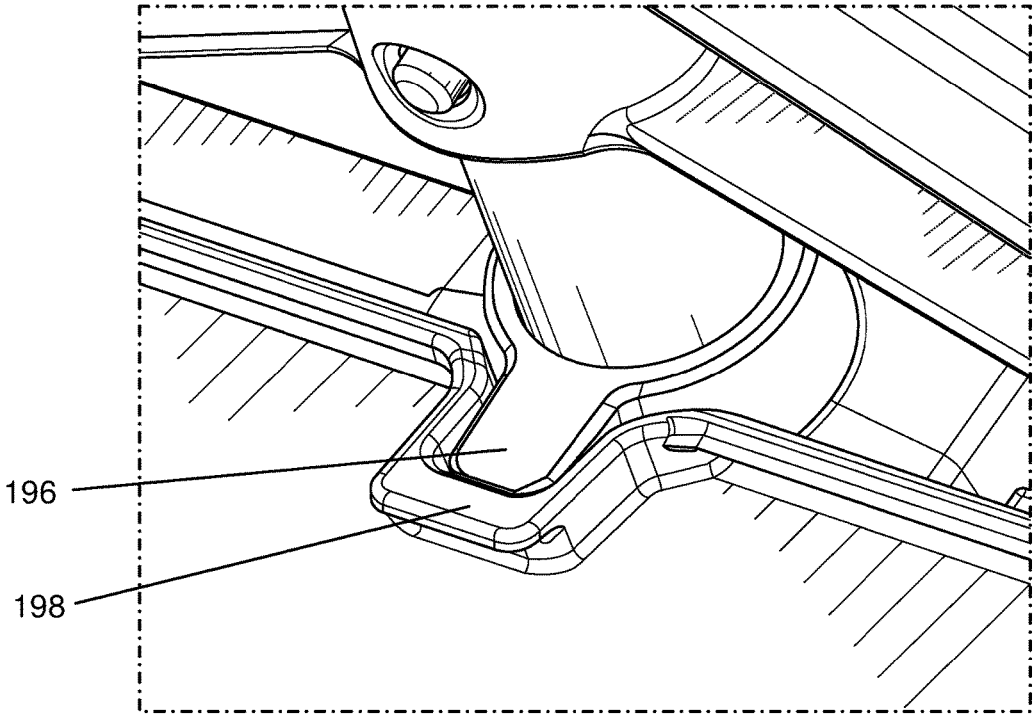
FIG. 21 is a top view of one embodiment of a projection on the yoke engaged with indention of the bin of FIG. 1.

In some embodiments, as shown in FIGS. 13 and 21, the yoke 150 includes a projection 196 that engages with an indention 198 of the bin 102. The projection 196 of the yoke 150 may engage with the indention 198 of the bin 102 once the latch 130 is engaged into the first or locked position 132. The projection 196 and indention 198 may help to guide the latch 130 into place before the latch 130 can engage with the yoke hook 156.

While the disclosure has been described with reference to a number of embodiments, it will be understood by those skilled in the art that the invention is not limited to such disclosed embodiments. Rather, the invention can be modified to incorporate any number of variations, alterations, substitutions, or equivalent arrangements not described herein, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

We claim:

1. A debris pan assembly, comprising:

a bin comprising a closed interior for containing debris, the closed interior being defined by at least one sidewall, the bin having an open end for receiving debris therethrough;

a yoke coupled to the bin, the yoke comprising at least two arms, each arm being coupled to a spindle, the yoke being coupled to the bin by the spindles such that the bin is rotatable about the spindles;

an elongated shaft having a first end and an opposed second end, the opposed second end being coupled to the yoke; and a latch coupled to the bin on an upper surface of the bin outside of the closed interior, wherein the latch is selectively pivotable between a first position in which the latch engages the yoke such that the bin and the yoke are rigidly positioned relative to one another, and a second position in which the bin and the yoke are not rigidly positioned relative to one another and the bin is freely rotatable about the spindles, wherein the latch comprises a grip coupled to a latch connection mechanism configured to allow a user to manually pivot the grip of the latch between the first position, in which the latch connection mechanism engages a hook coupled to the yoke, and the second position, in which the latch connection mechanism is disengaged from the hook.

2. The debris pan assembly of claim 1, further comprising a handle disposed at the first end of the elongated shaft.

3. The debris pan assembly of claim 1, further comprising at least two wheels coupled to the bin opposite the open end.

4. The debris pan assembly of claim 1, wherein the bin comprises a ramp having a first end coupled to the at least one sidewall of the bin and an opposed second end of the ramp coupled to a flexible lip extending along the second end.

5. The debris pan assembly of claim 1, further comprising at least one bumper protruding from an outer surface of the closed interior of the bin.

6. The debris pan assembly of claim 1, wherein the elongated shaft comprises a hollow tube having an elongated shaft aperture.

7. The debris pan assembly of claim 6, further comprising a push-button spring disposed within the hollow tube, such that the push-button extends through the elongated shaft aperture, the push-button being configured to selectively engage a yoke aperture.

8. The debris pan assembly of claim 1, wherein the open end of the bin defines a rim comprising at least one indention configured to engage with a projection on the yoke.

9. The debris pan assembly of claim 1, wherein:

the closed interior of the bin is further defined by a floor and a front ledge; and the bin further comprises a plurality of baffles protruding from the floor of the closed interior, wherein each of the plurality of baffles comprises a first surface facing the open end and an opposed second surface, the plurality of baffles being configured to slow debris flow inside the closed interior, wherein at least two baffles of the plurality of baffles separately extend from the at least one sidewall of the bin.

10. The debris pan assembly of claim 9, wherein the front ledge comprises a front face and a rear face, the front face opposing the first surface of the plurality of baffles.

11. The debris pan assembly of claim 9, wherein the bin further comprises a ramp having a first end coupled to the front ledge of the bin and an opposed second end of the ramp coupled to a flexible lip extending along the second end.

12. The debris pan assembly of claim 9, further comprising at least one bumper protruding from an outer surface opposite the closed interior of the bin.

13. The debris pan assembly of claim 9, wherein an outer surface opposite the closed interior of the bin comprises a channel configured to receive a user's fingers.

14. The debris pan assembly of claim 9, further comprising at least two wheels coupled to the bin opposite the open end.

15. The debris pan assembly of claim 1, wherein the latch is laterally pivotable between the first position and the second position along the upper surface of the bin.

16. The debris pan assembly of claim 1, wherein:

the yoke comprises a projection, and the bin comprises an indentation for receiving the projection when the latch is in the first position.

17. The debris pan assembly of claim 1, wherein the latch connection mechanism comprises a wire associated with the latch and configured to engage the hook of the yoke.

18. A debris pan assembly, comprising:

a bin comprising a closed interior for containing debris, the closed interior being defined by at least one sidewall, the bin having an open end for receiving debris therethrough;

a yoke coupled to the bin, the yoke comprising at least two arms, each arm being coupled to a spindle, the yoke being coupled to the bin by the spindles such that the bin is rotatable about the spindles; and a latch coupled to the bin on an upper surface of the bin outside of the closed interior, wherein the latch is selectively pivotable between a first position in which the latch engages the yoke such that the bin and the yoke are rigidly positioned relative to one another, and a second position in which the bin and the yoke are not rigidly positioned relative to one another and the bin is freely rotatable about the spindles, wherein the latch comprises a grip coupled to a latch connection mechanism configured to allow a user to manually pivot the grip of the latch between the first position, in which the latch connection mechanism engages a hook coupled to the yoke, and the second position, in which the latch connection mechanism is disengaged from the hook.

19. The debris pan assembly of claim 18, wherein the bin comprises a ramp having a first end coupled to the at least one sidewall of the bin and an opposed second end of the ramp coupled to a flexible lip extending along the second end.

20. The debris pan assembly of claim 18, wherein the latch is laterally pivotable between the first position and the second position along the upper surface of the bin.

* * * * *